US005983549A

United States Patent [19]

Battaglia

[11] Patent Number: 5,983,549

[45] Date of Patent: Nov. 16, 1999

[54] INERTIAL CYCLING SYSTEM FOR FIREARMS

[75] Inventor: Vincent Battaglia, Easton, Conn.

[73] Assignee: O. F. Mossberg & Sons, Inc., North Haven, Conn.

[21] Appl. No.: 09/121,926

[22] Filed: Jul. 24, 1998

[51] Int. Cl.[6] ..... F41A 3/00

[52] U.S. Cl. ..... 42/17

[58] Field of Search ..... 42/17, 10; 89/199

[56] References Cited

U.S. PATENT DOCUMENTS

| | | | |
|---|---|---|---|
| 447,836 | 3/1891 | Maxim | 42/17 |
| 954,546 | 4/1910 | Sjögren . | |
| 2,476,232 | 7/1949 | Williams | 89/182 |
| 2,480,074 | 8/1949 | Browning | 42/17 |
| 2,570,772 | 10/1951 | Crittendon | 89/190 |
| 2,586,509 | 2/1952 | Browning | 42/17 |
| 2,604,713 | 7/1952 | Browning | 42/17 |
| 2,626,475 | 1/1953 | Browning | 42/17 |
| 2,704,491 | 3/1955 | Prola | 89/182 |
| 2,719,375 | 10/1955 | Crittendon et al. | 12/17 |
| 2,973,694 | 3/1961 | Herlach et al. | 89/198 |
| 3,300,889 | 1/1967 | Baker et al. | 42/74 |
| 3,417,660 | 12/1968 | Harbrecht | 89/198 |
| 3,580,132 | 5/1971 | Vartanian | 89/130 |
| 3,977,296 | 8/1976 | Silsby et al. | 89/198 |
| 4,112,605 | 9/1978 | Staub | 42/1 V |
| 4,164,825 | 8/1979 | Hutchison | 42/1 V |
| 4,279,091 | 7/1981 | Edwards | 42/1 V |
| 4,514,921 | 5/1985 | Burkleca | 42/1 V |
| 4,558,628 | 12/1985 | Bosshard | 89/198 |
| 4,604,942 | 8/1986 | Benelli | 89/185 |
| 4,792,128 | 12/1988 | Holley | 267/118 |
| 4,838,527 | 6/1989 | Holley | 267/64.28 |
| 4,856,217 | 8/1989 | Benelli | 42/17 |
| 4,986,018 | 1/1991 | McDonald, Jr. | 42/1.06 |
| 5,020,570 | 6/1991 | Cotter | 137/596 |
| 5,279,202 | 1/1994 | Bellardi et al. | 89/198 |
| 5,303,906 | 4/1994 | Cotter et al. | 267/64.11 |
| 5,343,649 | 9/1994 | Petrovich | 42/1.06 |
| 5,513,730 | 5/1996 | Petrovich et al. | 188/271 |
| 5,524,374 | 6/1996 | Gernstein | 42/1.06 |
| 5,682,007 | 10/1997 | Dobbins | 42/70.08 |

FOREIGN PATENT DOCUMENTS

| | | |
|---|---|---|
| 352257 | 2/1961 | Germany . |
| 582 342 | 10/1976 | Germany . |

*Primary Examiner*—Charles T. Jordan
*Assistant Examiner*—Meena Chelliah
*Attorney, Agent, or Firm*—Peter W. Peterson; DeLio & Peterson, LLC

[57] ABSTRACT

A gun operating system for firearms, particularly for a shotgun, includes a bolt/slide movable between a closed position prior to firing and an open position after firing and a link operatively connected to the bolt/slide. An inertial recoil assembly housed in the gun stock is operatively connected to the link and includes a first mechanical an/or gas spring having a higher spring deformation rate in series with a second mechanical spring having a lower spring deformation rate. Upon firing of the gun, the bolt/slide is adapted to move to the open position and the link is adapted to initially deform the first spring in one direction and, subsequently, the first spring is adapted to return to its initial position and move the link and deform the second spring in the opposite direction.

19 Claims, 32 Drawing Sheets

INERTIAL CYCLING SYSTEM FOR FIREARMS

This application is related to U.S. Ser. No. (Attorney's Docket No. BTG 100002000) entitled SAFETY AND BOLT ASSEMBLY SYSTEM FOR FIREARMS by Vincent P. Battaglia and William Grehl filed on even date herewith.

BACKGROUND OF THE INVENTION

1. Field of the Invention

The present invention relates to gun operating systems and in particular, to a gun operating system for a shotgun which incorporates a safety and inertial recoil and accumulation system.

2. Description of Related Art

Operating systems for shotguns and other type of long guns, such as rifles, have long used springs in connection with recoil systems and operating systems. However, the recoil reduction systems were generally awkward stand alone systems, and the gun operating systems that relied on simple mechanical springs did not operate quickly enough, particularly to adapt to different shell sizes. Even those systems that use a combination recoil/operating mechanism, such as disclosed in U.S. Pat. No. 5,279,202, cannot be efficiently tuned to control the forces of recoil and bolt operation.

It would be advantageous to produce a gun operating system which is able to operate more quickly and also not work at odds with the control of recoil of the gun. Such operating system should be able to be efficiently tuned to control the forces of recoil and bolt operation, have a center of gravity which aides the shooter and be able to accept shells of a variety of lengths. It would also be desirable to produce such a gun which employs an improved safety system and which provides for rapid and facile disassembly of the bolt/slide without removing the operating system from the gun.

Bearing in mind the problems and deficiencies of the prior art, it is therefore an object of the present invention to provide a combined bolt operating and recoil system which is able to efficiently absorb recoil and provide for quick and efficient bolt operation.

It is another object of the present invention to provide an operating system which operates more quickly through the firing cycle.

It is yet another object of the present invention to provide a gun operating system which has an advantageous center of gravity for the shooter.

A further object of the invention is to provide a gun operating system which incorporates an improved safety system.

It is a still further object of the invention to provide a gun operating system which permits disassembly of the bolt/slide without removing the operating system from the gun.

Still other objects and advantages of the invention will in part be obvious and will in part be apparent from the specification.

SUMMARY OF THE INVENTION

The above and other objects, which will be apparent to those skilled in the art, are achieved in the present invention which in a first aspect relates to a gun operating system comprising a bolt/slide movable between a closed position prior to firing of the gun and an open position after firing of the gun and a link operatively connected to the bolt/slide and movable therewith. An inertial recoil assembly is operatively connected to the link, the recoil assembly comprising a housing, a first spring having a first and a second end, and a second spring having a first and a second end. The first spring is movable within the housing between initial and deformed positions in a first direction, and the second spring is movable within the housing between initial and deformed positions in a second direction. The first spring has a spring deformation rate higher than a spring deformation rate of the second spring. The first and second springs are operatively located in series within the recoil assembly housing. Upon firing of the gun, the bolt/slide is adapted to move to the open position and the link is adapted to initially deform the first spring in the first direction and, subsequently, the first spring is adapted to return to an initial position and move the link and deform the second spring in the second direction.

Preferably, the housing of the recoil assembly is located in a gun stock, the second end of the first spring is operatively connected to the link and to the first end of the second spring, and the first and second springs are operatively connected in series within the recoil assembly housing.

In one embodiment, the first spring comprises a mechanical spring having a deformation rate significantly higher than the deformation rate of the second spring. In another embodiment, the first spring comprises a gas spring having a deformation rate significantly higher than the deformation rate of the second spring. In yet another embodiment, the first spring comprises a mechanical spring, and further includes a gas spring operatively connected in series to the mechanical spring. The second spring is adapted to deform a greater distance than the first spring upon firing of the gun.

Preferably, the link comprises first and second members connected by a pin and rotatable with respect to each other. The link may comprise first and second link members, the first link member being operatively connected to the bolt/slide and the second link member being operatively connected to the first spring, and further include means for rigidly connecting the second link member to the first spring when the first spring is in the initial position. The link may also comprise first and second link members connected by a pin, the first link member being operatively connected to the bolt/slide and the second link member operatively connected to the first spring, the second link member being rigidly connected to the first spring when the first spring is in the initial position. The link may further include a guide member having an opening therein in operative contact with the first end of the first spring, wherein a portion of the second link member is rigidly secured within the opening of the guide member when the first spring is in the initial position.

The system may further include an inertial mass movable in the housing between the first and second springs.

In a related aspect, the present invention relates to a gun operating system comprising a bolt/slide movable between a closed position prior to firing of the gun and an open position after firing of the gun and a link operatively connected to the bolt/slide and movable therewith. There is also provided an inertial recoil assembly operatively connected to the link, the recoil assembly comprising a housing located within a gun stock, a first spring having a first and a second end, and a second spring having a first and a second end. The first spring is movable within the housing between initial and deformed positions in a first direction, and the second spring is movable within the housing between initial and deformed positions in a second direction, with the first spring having a spring deformation rate significantly higher than a spring deformation rate of the second spring. The first and second springs are operatively located in series within the recoil assembly housing, the second end of the first spring being operatively connected to the link and to the first end of the second spring. An inertial mass is movable in the housing between the first and second springs. Upon firing of the gun, the bolt/slide is adapted to move to the open position and the link is adapted to initially deform the first spring in the first direction and, subsequently, the first spring is adapted to return to an initial position and move the link and deform the second spring in the second direction.

In another aspect, the present invention relates to a gun operating system comprising a bolt/slide movable between a closed, locked position prior to firing of the gun and an open, unlocked position after firing of the gun and a movable recoil assembly for operating the bolt/slide upon recoil of the gun immediately after firing. Link means operatively connect the bolt/slide and recoil assembly, the link means being adapted to remain essentially rigid when the bolt/slide is in the closed, locked and open, unlocked positions, except immediately after firing when the link is adapted to permit flexibility in a direction normal to movement of the recoil assembly.

Preferably, the link means comprises first and second members connected by a pin and rotatable with respect to each other. The first link member may be operatively connected to the bolt/slide and the second link member may be operatively connected to the recoil assembly. There may be further included means for rigidly connecting the second link member to the recoil assembly.

The link may comprise first and second link members connected by a pin, the first link member being operatively connected to the bolt/slide and the second link member operatively connected to the recoil assembly. There may be further included a guide member having an opening therein in operative contact with the recoil assembly, wherein a portion of the second link member is rigidly secured within the opening of the guide member when the recoil assembly is in an initial position.

In yet another aspect, the present invention relates to a gun safety system comprising a bolt having an opening therein for a firing pin, the bolt being movable between a first position prior to firing of the gun and a second position after firing of the gun. A firing pin is slideable within the bolt to strike a shell in the gun, the firing pin being movable between a first position whereby the firing pin is aligned with the opening and capable of sliding movement to strike the shell and a second position whereby the firing pin is out of alignment with the opening and incapable of sliding movement to strike the shell.

The system may include first means to slide the firing pin away from the shell and second means to move the firing pin from the first to the second positions.

In a related aspect, the invention provides a gun safety system comprising a bolt having an opening therein for a firing pin, the bolt being movable between a first position prior to firing of the gun and a second position after firing of the gun and a firing pin slideable within the bolt to strike a shell in the gun. The system includes spring means for urging the firing pin away from the shell and positive displacement means for moving and retaining the firing pin away from the shell when the bolt is in the second position.

In yet another aspect, the present invention provides a bolt/slide system for a gun wherein the bolt/slide is moveable within a receiver of a gun during operation thereof and completely removable from the receiver upon completion of operation. A link is adapted to connect the bolt/slide to a bolt operating system, a pin is secured to one of the bolt/slide or link, and a slot is present in the other of the bolt/slide or link and is adapted to receive the pin. The slot is preferably angled rearward to prevent movement of the pin from the slot during movement of the bolt/slide in the direction of the link. A support member, preferably a leaf spring, is adapted to secure the pin within the slot during operation of the gun. The support member is movable to permit the pin to be removed from the slot while secured to the one of the bolt/slide or link and to permit the bolt/slide to be completely removed from the receiver without removing the operating system from the gun.

The bolt/slide system may also include a handle adapted to move the bolt/slide within the receiver, with a leaf spring securing member external to the handle adapted to removably secure the handle to the bolt/slide.

The present invention is particularly adapted for use in a shotgun, rifle or other gun having a barrel, barrel extension and stock for resting against a user's shoulder. The inertial recoil assembly may be housed in the stock and is adapted for semi-automatic operation to repeatedly open and close the bolt/slide upon firing.

BRIEF DESCRIPTION OF THE DRAWINGS

The features of the invention believed to be novel and the elements characteristic of the invention are set forth with particularity in the appended claims. The figures are for illustration purposes only and are not drawn to scale. the invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1A:
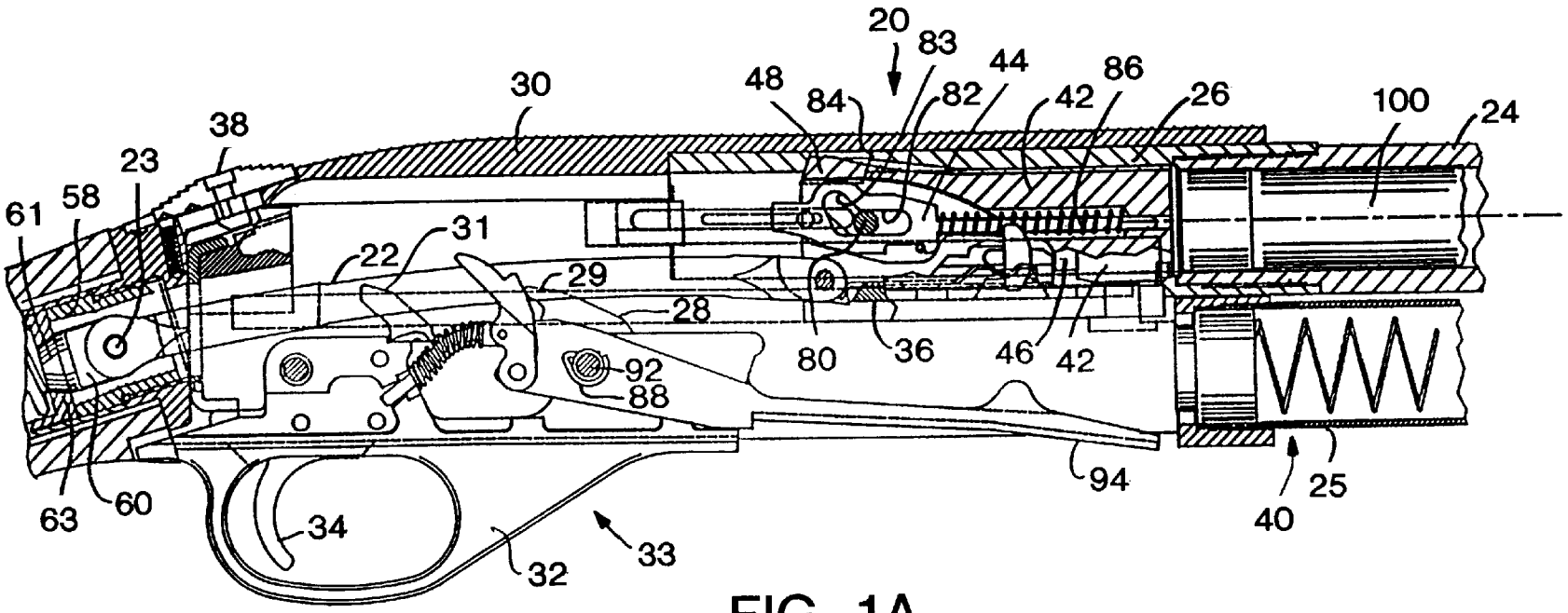
FIG. 1*a* is a side elevational view in cross-section of the barrel extension portion of a first preferred shotgun of the present invention at the time that the bolt and slide are in battery position before firing.

In describing the preferred embodiment of the present invention, reference will be made herein to FIGS. 1–25 of the drawings in which like numerals refer to like features of the invention. Features of the invention are not necessarily shown to scale in the drawings.

Battery Position—FIGS. 1*a* and *b*

Figure 1B:
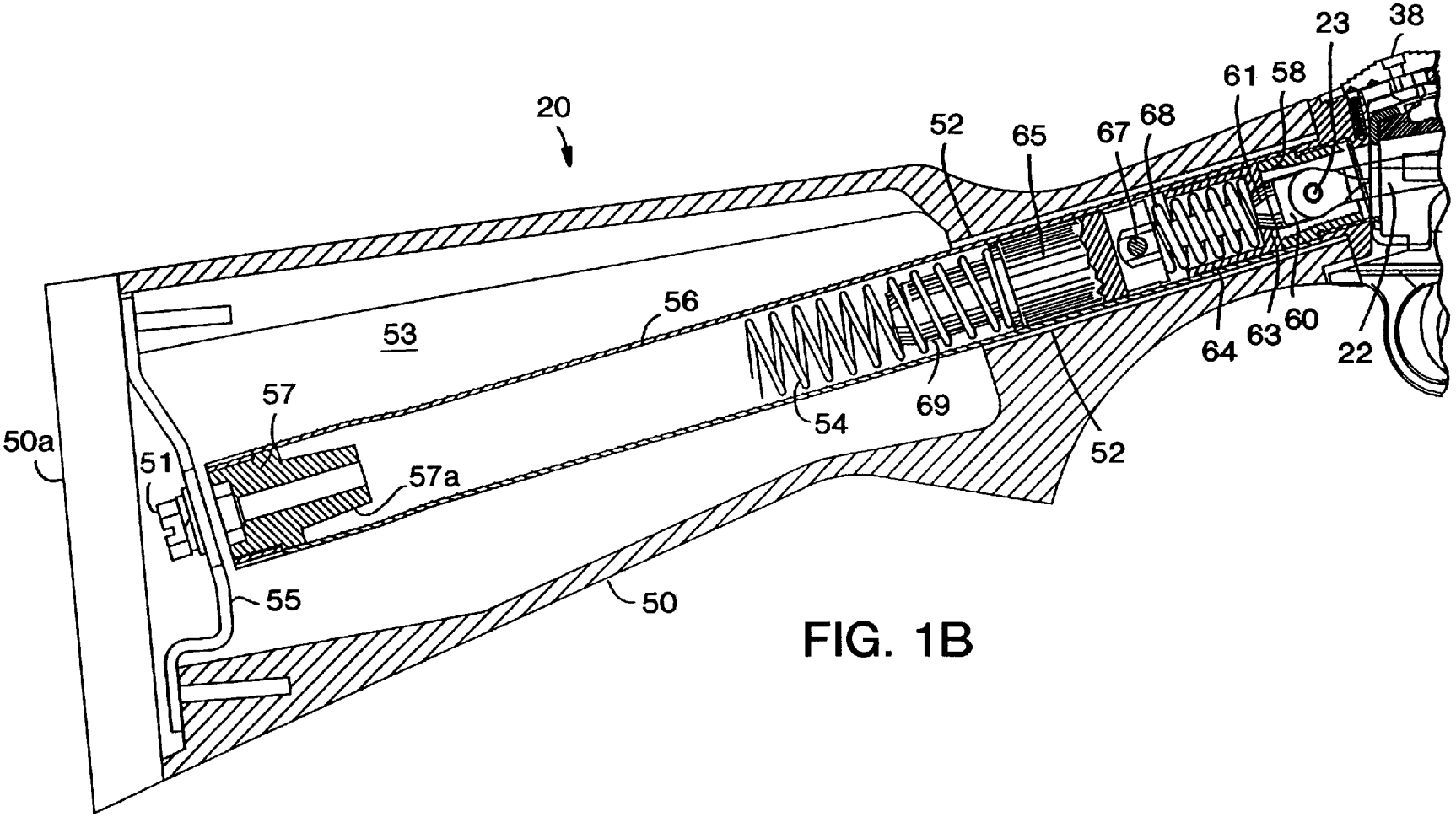
FIG. 1*b* is a side elevational view in cross-section of the stock portion of the first preferred shotgun of the present invention at the time that the bolt and slide are in battery position before firing.
Figure 7:
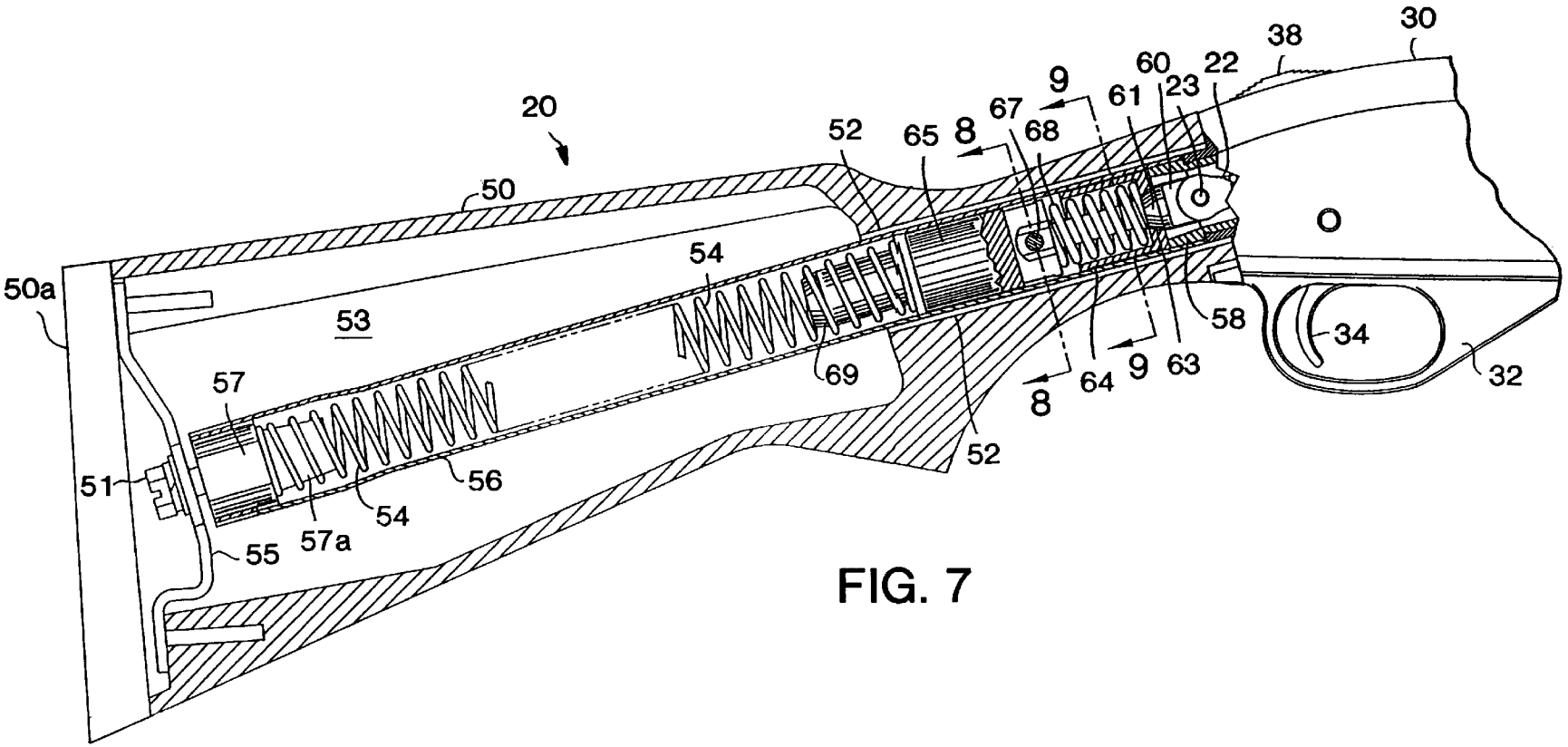
FIG. 7 is a side elevational view partially in cross-section showing the stock inertia spring portion of the present invention in the battery position.
Figure 8:
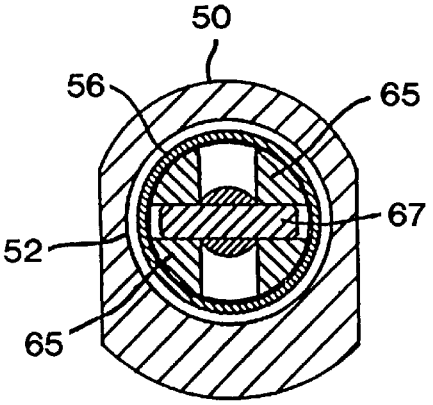
FIG. 8 is a sectional view along line 8—8 of FIG. 7.
Figure 9:
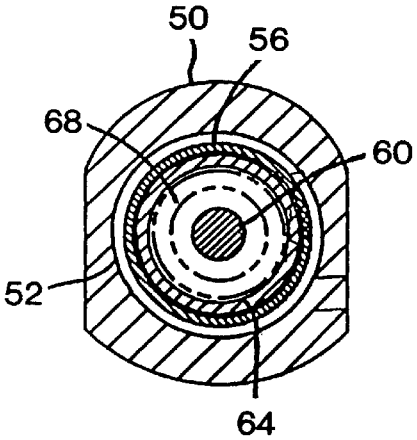
FIG. 9 is a sectional view along line 9—9 of FIG. 7.

One embodiment of the preferred shotgun of the present invention is depicted in an initial position in FIGS. 1*a* and 1*b*, and in FIGS. 7, 8 and 9, in which the bolt and slide are in battery position with the shell loaded, immediately prior to firing.

The shotgun 20 includes barrel 24 at the front of the gun and stock 50 at the rear of the gun. The terms front and rear as used herein conform to these directions. Rearward of the barrel, barrel extension 26 within receiver 30 has disposed within it a moveable bolt 42 and bolt/slide 36 mechanism for accepting and firing a shotgun shell 100. The bolt/slide moves on tracks within the receiver and the bolt is secured to the bolt/slide. The bolt includes an integral bolt lock 48 which extends upward into window 84 of the barrel extension and locks the bolt in place. Slidable within bolt 42 is a spring return flat firing pin 44 which has a lock/unlock slot 82 which slides forward and rearward about bolt cam pin 80. The lock/unlock slot in the firing pin extends horizontally in the forward section and extends upward at an approximately 45 degree angle in the rearward section. Bolt 42 also contains lock/unlock slot 83 in the same configuration and the position depicted for lock/unlock slot 82. In FIG. 1*a*, the two slots 82 and 83 are coincidental, i.e., in the same position as seen in side view, although, the firing pin may move independently of the bolt. A compression spring 86 around firing pin urges the spring rearward away from the shell.

Figure 2A:
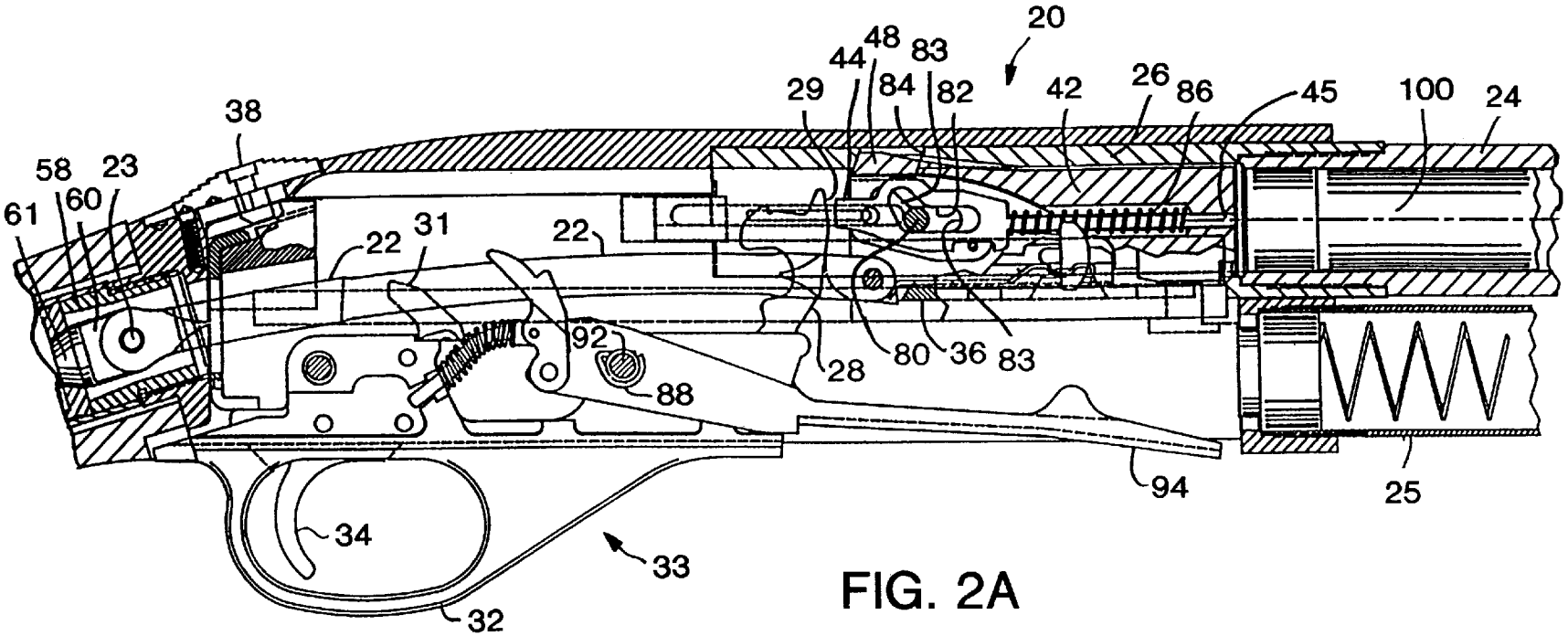
FIG. 2*a* is a side elevational view in cross-section of the barrel extension portion of the embodiment of FIG. 1*a* at the time that the firing pin strikes the shell primer.

Also shown in FIG. 1*a* is the trigger group or fire control mechanism 33 comprising trigger housing 32, trigger 34, hammer 28 and hammer spring 88. When trigger 34 is moved rearward, it releases hammer 28 which urged by spring 88 pivots around a pin 92 such that the hammer face 29 strikes the rearward portion of the firing pin 44 (FIG. 2*a*). Hammer 28 passes through a slot in link 22, which connects the bolt to the inertial recoil assembly, discussed further below.

Before firing, slide 36 is also separated from the bolt by gap 46, preferably a distance of approximately 0.200 inches.

Figure 10A:
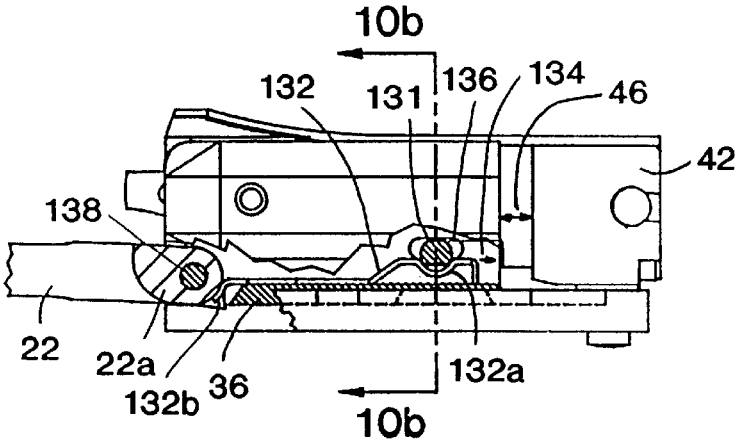
FIG. 10*a* is a side elevational view, partially in cross-section, of the rearward portion of the bolt and slide assembly in the receiver of the gun depicted in FIG. 1*a* and *b*.

(See also FIG. 10*a*.) The reason for this separation is to permit a delay in accumulation of force within the operating system, as will be explained in more detail below. Within receiver 30 in the main body of the shotgun, an elongated detachable link 22 extends between the rearward portion of slide 36 and the inertial system within the stock 50 portion of the shotgun. As discussed above, link 22 has a slot through its mid-portion to permit free movement of hammer 28.

Figure 10B:
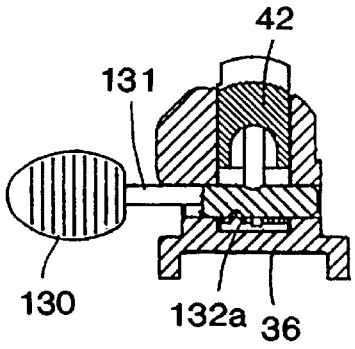
FIG. 10*b* is a cross-sectional view along lines 10*b*—10*b* of FIG. 10*a*.
Figure 10C:
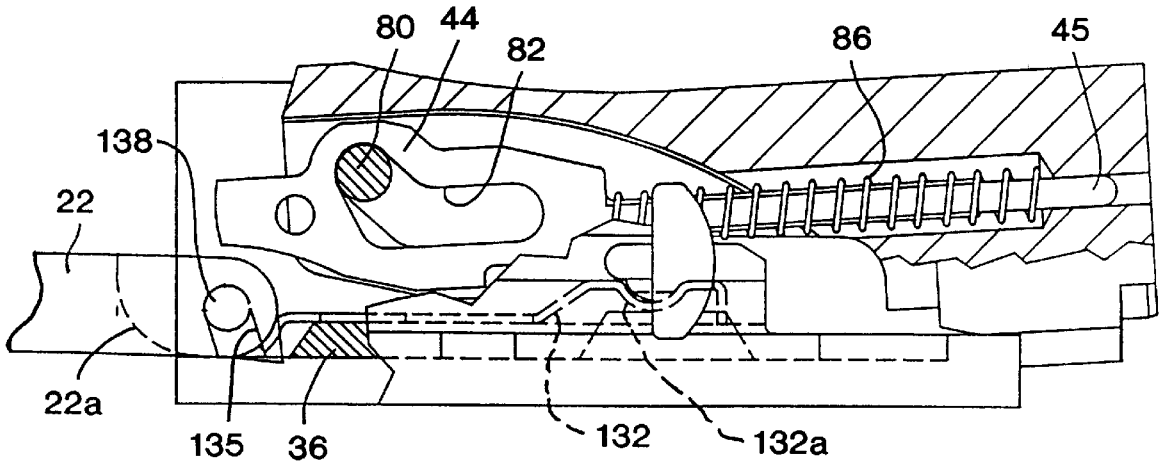
FIG. 10*c* is a side elevational view, partially in cross-section, of a portion of the detachable connection of the slide to the link depicted in FIG. 10*a*.

As shown in FIGS. 10*a*, 10*b* and 10*c*, the bolt 42, slide 36 assembly is adapted for facile and rapid disassembly of link 22. Link forward end 22*a* is secured by pin 138 to bolt/slide 36, which pin may be attached to either the slide or link, but is preferably secured to the link as shown. A slot 135 extends upward and rearward in slide 36 to receive pin 138. (FIG. 10*c*.) This configuration acts to prevent movement of the pin from the slot during rearward movement of the bolt/slide. (If the pin is to be attached to slide 36, then the slot would be located in link end 22*a*.) The rearward end portion 132*b* of slidable support member 132, preferably comprising a leaf spring, is curved to conform to and hold link end 22*a* with pin 138 in position in slot 135. The forward end 132*a* of spring 132 forms a detent with shaft 131 of cocking handle 130. During operation of the gun, detent 132*a* locks handle 130 and shaft 131 in place, and further locks link 22 to bolt/slide 36. However, handle 130 may be easily removed before or after gun operation by pulling outward, which causes the central portion of spring 132 to deflect downward and unlocks the detent 132*a*. Once handle 130 is removed, spring 132 may slide forward in the gap as shown by arrow 134 to permit link end 22*a* to be disconnected from the bolt/slide, and permit the bolt/slide to be completely removed from the receiver, through the rearward end of the barrel extension, without removing the inertial recoil gun operating system to which link 22 is connected at its rearward end.

The inertial recoil assembly is contained within a hollowed out cavity 53 of stock 50, the rear stock end 50*a* of which abuts the user's shoulder. A circular bore 52 extending along the longitudinal axis of stock 50 receives within it an inertial recoil and accumulation system which comprises a relatively low spring rate return compression spring 54 and a shorter, relatively high spring rate accumulator compression spring 68, both received within cylindrical guide tube 56. Guide tube 56 is at an angle of about 16° with respect to barrel 24. At the forward end of guide tube 56 is a thrust bushing 58 which is press fit and mechanically fastened within tube 56. The rearward end of guide tube 56 has received within it bushing 57 which has at a forward portion guide plug 57*a* which receives the rearward end of return spring 54. Bushing 57 is bolted by fastener 51 to bracket 55 which is secured within cavity 53 at the rearward end of stock 50. (See also FIG. 7.)

The rearward portion of link 22 passes through the thrust bushing and is connected by pin 23 to inertia return link 60 within guide tube 56. Inertia return link 60 includes a cone-shaped portion 61 which mates with comparable cone-shaped opening 63 in the forward end of accumulator spring cup 64. As shown in the position depicted in FIG. 1*b*, inertia return link cone 61 is fully received within spring cup opening 63, which prevents movement of link 60 in a direction normal to the length of the link, such that links 22 and 60 act as an essentially rigid, one-part link when moving forward or back.

Link 60 is coaxially received within accumulator spring 68, which is shown contained in a pre-loaded (partially compressed) condition within accumulator spring cup guide member 64 which is itself slideable within guide tube 56 (FIG. 9). The forward end of accumulator spring 68 contacts the inside front end of spring cup 64, and the back end of spring 68 is connected to inertial mass 65 by pin 67 (FIG. 8). Preferably, the inertial mass has a mass of about 0.5 lb. (0.25 kg). In the position shown, accumulator spring cup 64 contacts thrust bushing 58, thus preventing further forward movement. The rearward end of spring cup 64 is open. Inertia return link 60 is connected by pin 67 to inertia weight 65 which is slideable within guide tube 56. Inertial mass 65 is also in contact with return spring 54, which is secured at its forward end around guide portion 69. The rearward end of return spring 54 is in contact with and secured to the rearward end of guide tube 56 around guide portion 70.

Return spring 54 urges inertia link 60 and accumulator spring 68 forward within the tube, while the accumulator spring is compressed within accumulator spring cup 64. In the position depicted in FIG. 1*b*, the return spring is fully extended (although still partially compressed) in its initial position and the accumulator spring has minimum compression (also in its initial position), and both are in equilibrium. In the preferred embodiment of the present invention, the return spring load will range from 3 lbs. (1.36 kg) in the fully extended position, as shown in FIG. 1*b*, to a maximum of approximately 8 lbs. (3.62 kg) in the fully compressed position (discussed below). The accumulator spring will have an initial preloaded compression force greater than or equal to about 60 lbs. (27.2 kg) which will increase to approximately 350 lbs (158 kg) at 0.200 in. (5 mm) deflection.

With the bolt/slide assembly in the battery position locking the bolt into the barrel extension lock window, the weapon is ready for ignition. A conventional safety 38 is applied preventing operation of the trigger assembly. The magazine tube 25 is then loaded with three additional shells for a total capacity of four shells. The weapon is now fully loaded and poised for firing.

Fired Position—FIGS. 2*a* and *b*

Figure 2B:
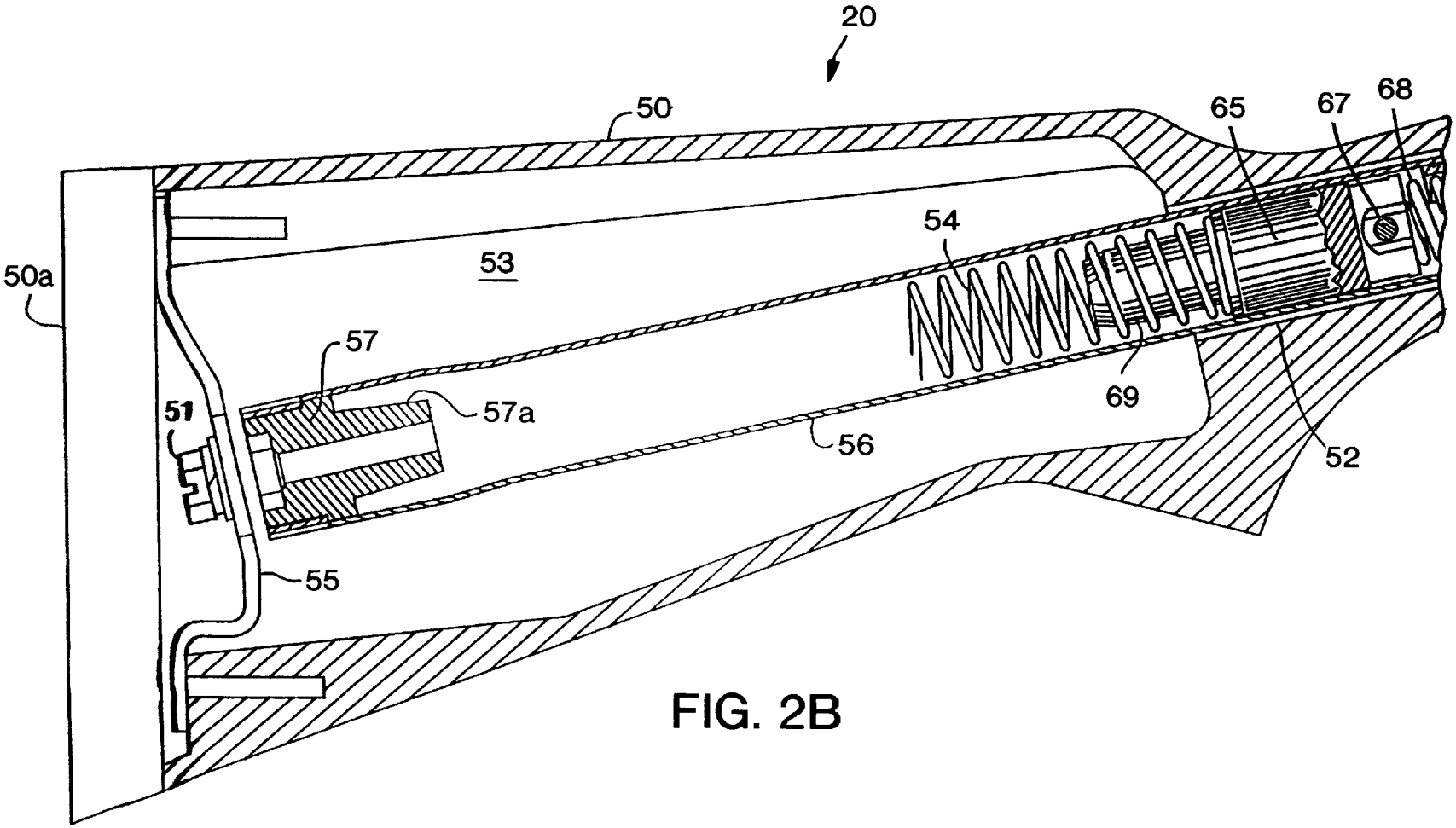
FIG. 2*b* is a side elevational view in cross-section of the stock portion of the embodiment of FIG. 1*b* at the time that the firing pin strikes the shell primer.

The shooter now takes safe aim and releases the safety slide 38 forward arming the trigger group. Upon squeezing trigger 34, hammer 28 is released striking firing pin 44 into the shell 100 primer causing ignition. As depicted in FIGS. 2*a* and 2*b*, the trigger has been pulled and the hammer face 29 has struck and moved firing pin 44 forward against the force of spring 86 such that the firing pin face 45 strikes the primer at the rear of shell 100. The lock/unlock slot 82 within firing pin 44 is now slid forward along bolt retaining pin 80. In the position shown in FIG. 2*a*, the bolt itself has not moved from the position of FIG. 1*a* and, therefore, the lock/unlock slot 83 of the bolt and lock/unlock slot 82 of the firing pin are now in different positions. Bolt lock 48 remains within window 84 of the barrel extension continuing to lock the bolt in place as the firing pin strikes the primer, causing ignition. The compression spring 86 which extends around the firing pin within the bolt is now fully compressed. In the stock section of the shotgun shown, the inertial system has not yet reacted since links 22 and 60 attached to the slide have not yet moved and the components therein are in the same position in FIG. 1*b*.

It is believed that the initial ignition of the primer causes a momentary vacuum within the shell as air is consumed within the shell and the forces are negative for approximately the first 5 milliseconds. As the force line increases and crosses the zero axis, the gun operating system begins to move to the position shown in FIGS. 3*a* and 3*b* as ignition forces rapidly accelerate.

Figure 3A:
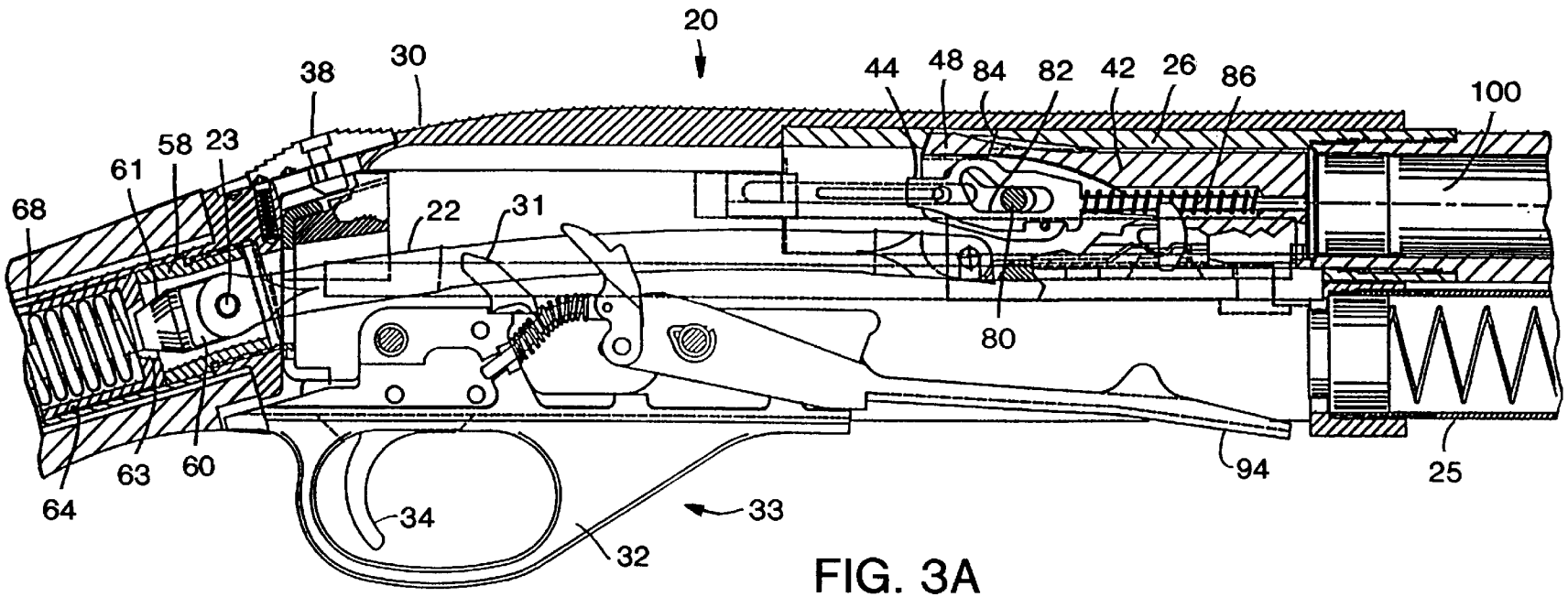
FIG. 3*a* is a side elevational view in cross-section of the barrel extension portion of the embodiment of FIG. 1*a* at the time that the slide is in the forward position immediately following ignition.
Figure 3B:
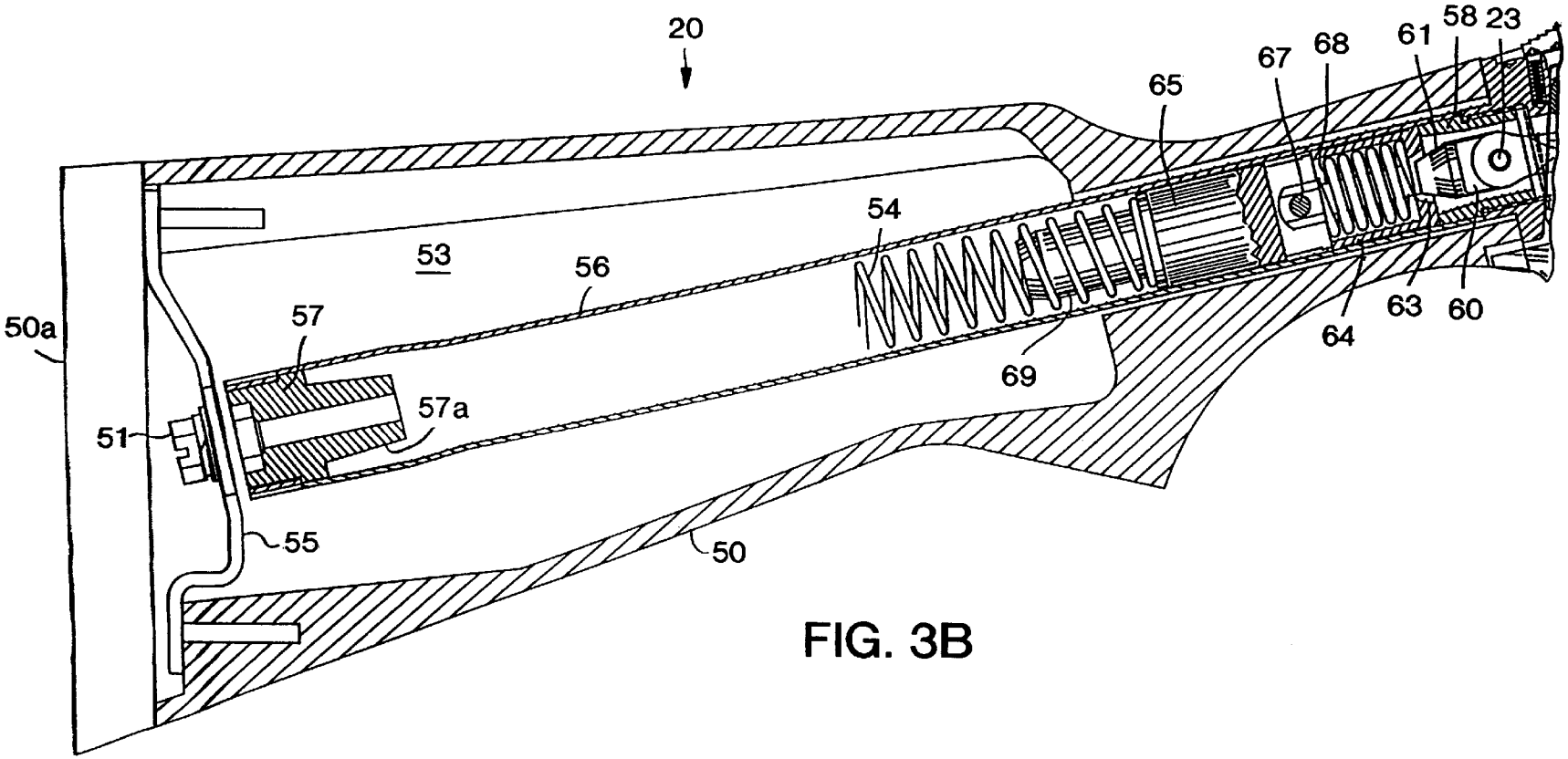
FIG. 3*b* is a side elevational view in cross-section of the stock portion of the embodiment of FIG. 1*b* at the time that the slide is in the forward position immediately following ignition.

Accumulation Position—FIGS. 3*a* and *b*

As detonation of the shell's main power charge occurs, chamber pressure builds in the shell as it is restrained by bolt and barrel diameter, causing the ejecta or payload of shell 100 to move in the forward direction, out the barrel. The ejecta is now accelerating to peak pressure and terminal velocity and further into pressure decay as the ejecta travels down and out the barrel.

After firing, the body of gun 20 tends to move backward (opposite the direction of the shell ejecta) in recoil. Since inertia weight 65 is held between springs 54 and 68 and is slideable within guide tube 56 (which is itself aligned approximately along the axis of discharge of the shell ejecta), simultaneously to the weapon recoil, the inertia weight tends to resist rearward movement, and thus moves forward with respect to the gun, in the direction of the ejecta. As inertia weight 65 moves (relatively) forward within guide tube 56, accumulator spring 68 is compressed and restrained in the accumulator spring cup and against the thrust bushing, causing the accumulator spring to accumulate energy equal to the velocity and mass of the opposed shell ejecta in ignition. The rate of accumulation is proportional to the ejecta's mass and velocity and is predetermined to cycle the action. Accumulation is timed to occur during and through the shells pressure curve as when the ejecta has displaced its greatest energy through its mass. Forward movement of inertia weight 65 causes inertia return link 60 to move forward, which in turn causes link 22 to move forward. Because accumulator spring cup 64 is prevented from further forward movement by thrust bushing 58, return link cone portion 61 is pushed out of contact with spring cup cone opening 63. Since links 60 and 22 remain connected to each other by pin 23, but not rigidly, link 60 may now rotate to a limited degree with respect to link 22. Link 60 now has limited movement and flexibility in the up-and-down direction normal to its length to accommodate the slight change in direction between the stock and the receiver.

In FIG. 3*a*, as a result of the recoil of the gun after firing, slide 36 has now moved forward relative to bolt 42 and the initial accumulation gap 46 has now been reduced, although not fully eliminated, depending upon the strength of the charge in the shell. It is preferred that the bolt not contact the slide in this area, so that the shell is not jammed in the chamber of the barrel. As the main shell charge ignites from the primer, firing pin 44 begins to return as a result of the extension force of spring 86 and the firing pin 45. Bolt lock 48 is still fully extended into window 84 to lock up the bolt.

As the ignition forces approach maximum, the accumulator spring begins to accumulate energy from the ignition of shell 100 and approaches a maximum compressed position approximately 20–25 milliseconds after ignition. After the maximum ignition forces are experienced (at approximately 25 milliseconds), the ignition forces begin to decline.

Figure 4A:
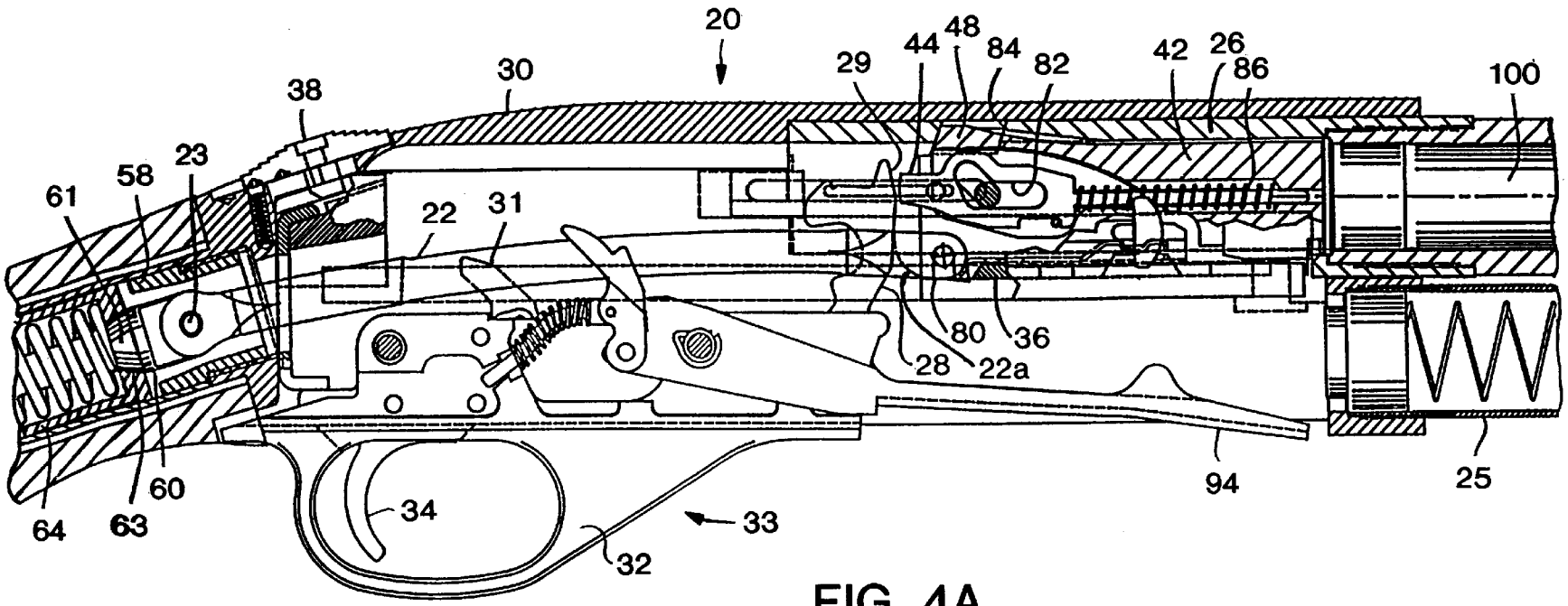
FIG. 4*a* is a side elevational view in cross-section of the barrel extension portion of the embodiment of FIG. 1*a* at the time that the slide is beginning to unlock.

Start-To-Unlock Position—FIGS. 4*a* and *b*

At this point in time the accumulator spring has fully stored its kinetic energy potential and is waiting for its stored energy to become of a greater force then the recoil force which is in decay. At the instant that accumulation force is greater than recoil force, the closed accumulator spring fully opens causing the entire inertia assembly to move rearward (opposite ejecta direction), and the connected links and slide then unlock the bolt.

Figure 4B:
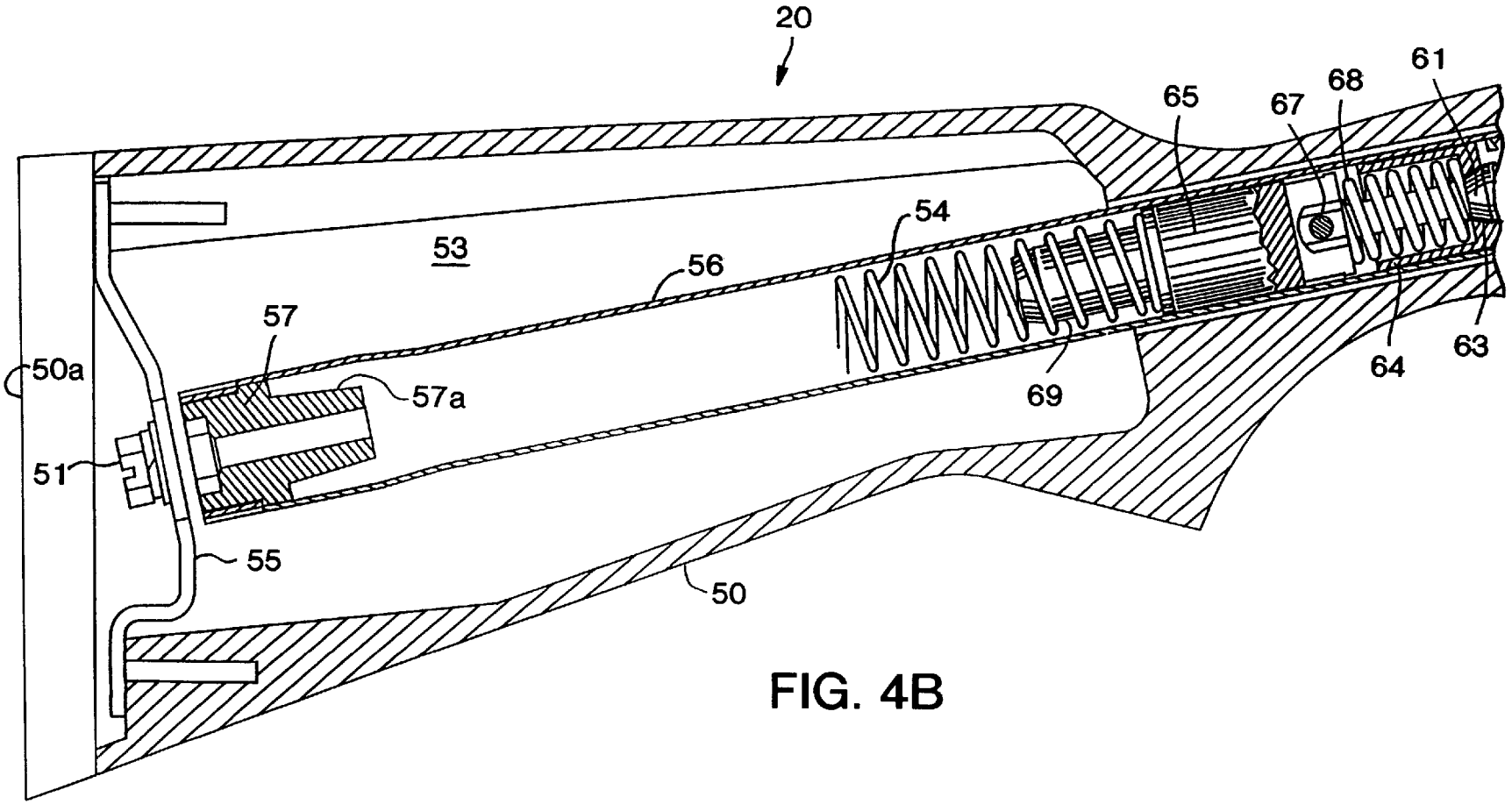
FIG. 4*b* is a side elevational view in cross-section of the stock portion of the embodiment of FIG. 1*b* at the time that the slide is beginning to unlock.

As shown in FIGS. 4*a* and 4*b*, shortly after the commencement of the decline of the ignition forces, in the stock inertial system accumulator spring 68 begins to expand and release the stored energy. As this occurs, link 60 moves rearward, against inertia weight 65, returning cone portion 61 into the captured position within accumulator spring cup opening 63. Accumulator spring 68 is returned to its initial position. (FIG. 4*b*). The accumulator cup 64 also moves backward in guide tube 56, separating from thrust bushing 58. As inertia weight 65 is pushed back, return spring 54 also begins to compress. As a result of the rearward movement of link 60, link 22 begins to move rearwards and pulls slide 36 in the same direction to begin to unlock bolt 42 until cam pin 80 hits the angled portion of slot 82, which disengages bolt 42 out of the locked position. A slot end radius 22*a* at the forward end of link 22 cams hammer 28 backwards around pin 92 to the cocked position. The elevator 94 lock mechanism and the trigger disconnect pawl 31 are tripped. This mechanism acts as a safety device to mechanically disconnect the trigger from activation of the firing pin, and will be explained further below.

Figure 5A:
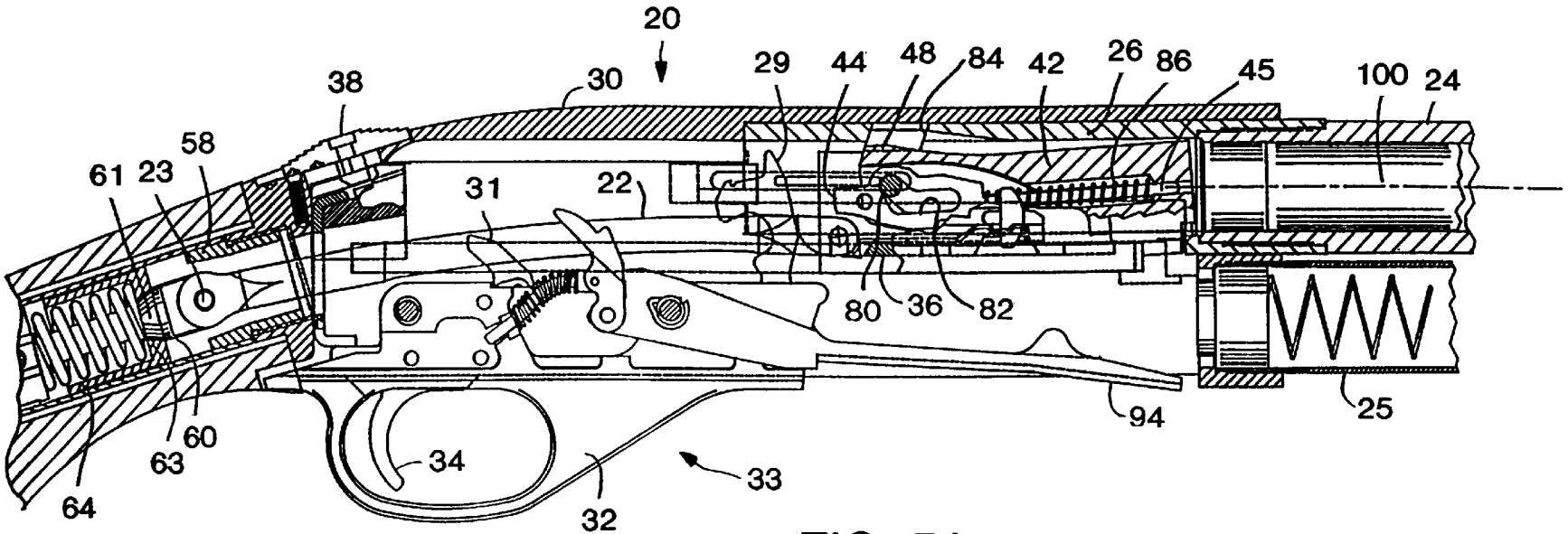
FIG. 5*a* is a side elevational view in cross-section of the barrel extension portion of the embodiment of FIG. 1*a* at the time that the slide is in the full unlock position.

Fully Unlocked Position—FIGS. 5*a* and *b*

Figure 5B:
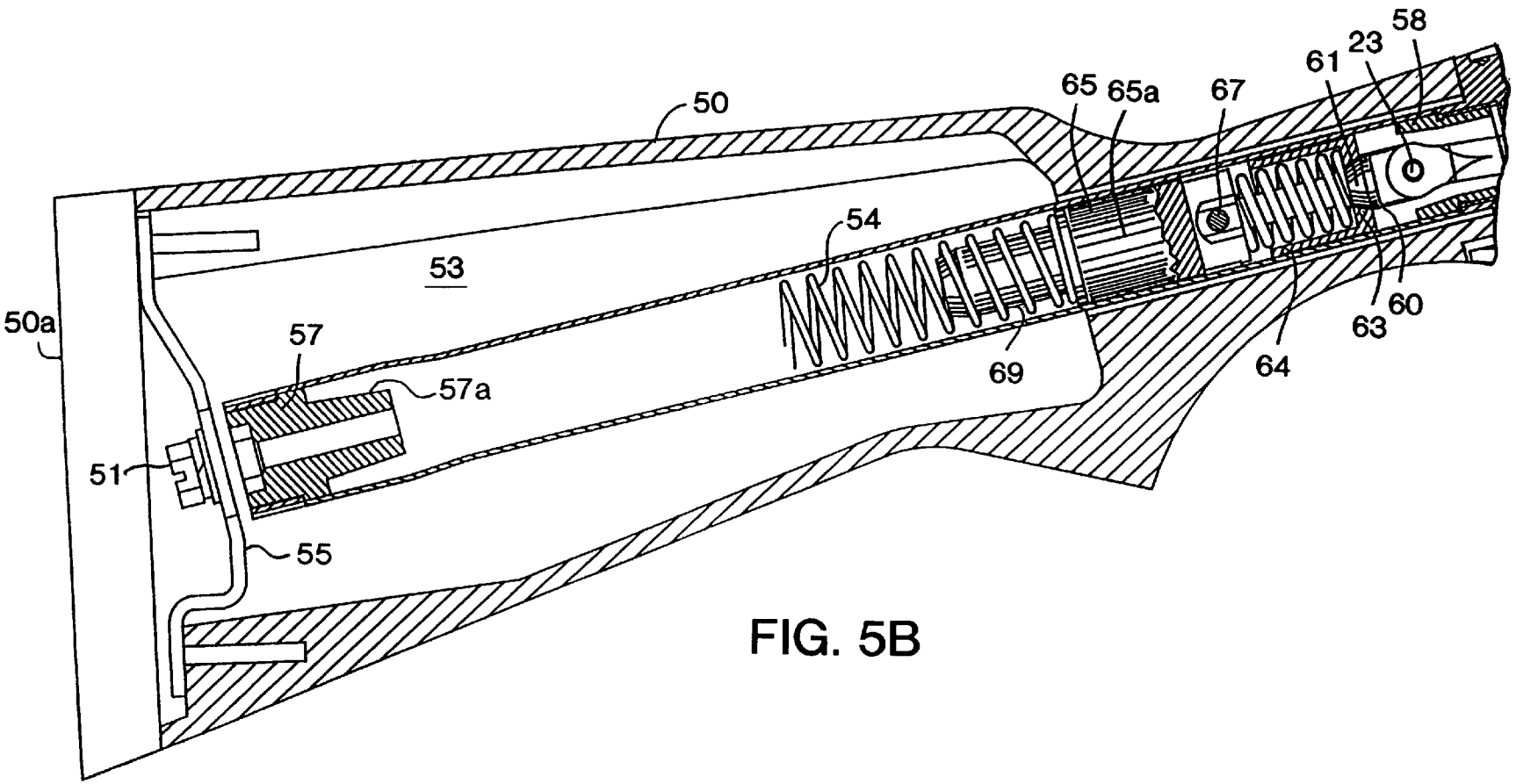
FIG. 5*b* is a side elevational view in cross-section of the stock portion of the embodiment of FIG. 1*b* at the time that the slide is in the full unlock position.

In FIGS. 5*a* and 5*b*, as ignition forces continue to decay, the bolt is now positively displaced completely out of the lockup position such that bolt lock face 48 is pushed down below window 84 within the barrel extension. As a result of the tripping of the disconnect mechanism, firing pin 44 is completely pushed forward around bolt retaining pin 80 such that pin 80 is now in the rearward portion of the lock/unlock slot 82, which provides the positive displacement, and bolt lock 48 is completely removed from window 84 (FIG. 5*a*). Firing pin face 45 is canted upward and is completely blocked from being able to strike the primer in a shell. This mechanical disconnection of the firing mechanism prevents possibility of a side rupture which would result from inadvertently igniting the shell with the gun receiver in the open position.

In the rear stock inertial system (FIG. 5*b*), return spring 54 continues to compress. As inertial mass 65 moves rearward within tube 56, inward grooves 65*a* around the mass permit air to pass as it is compressed in the guide tube rearward of the cylinder. This outrush of air travels forward through the guide tube into the receiver, where it may evacuate any loose debris from the guide tube into the receiver. Accumulator spring 68 remains in its initial position.

After unlocking, the shell is ejected by a conventional ejector (not shown).

Figure 6A:
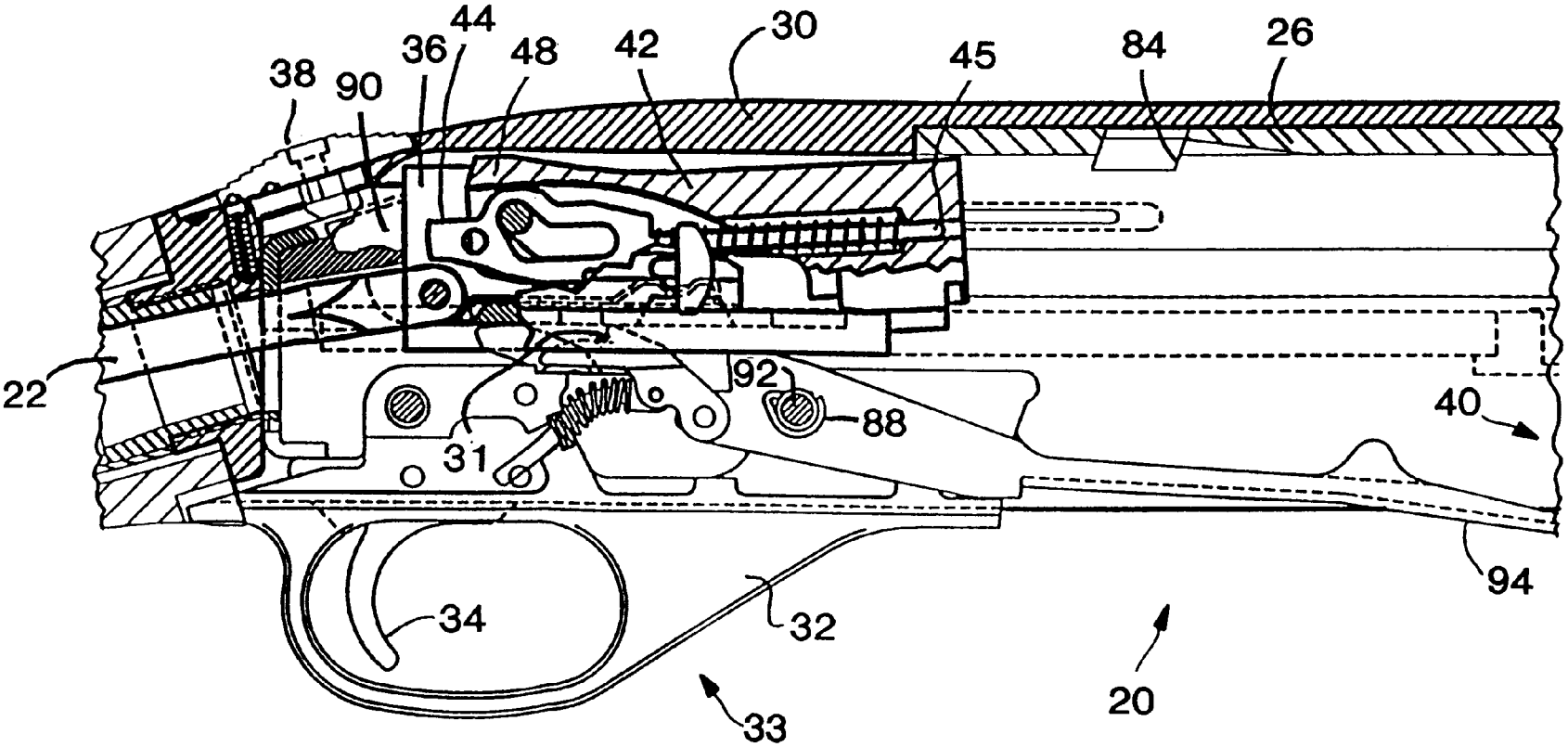
FIG. 6*a* is a side elevational view in cross-section of the barrel extension portion of the embodiment of FIG. 1*a* at the time that the bolt and slide are in the full rearward position.

Bolt Open Position—FIGS. 6*a* and *b*

Figure 6B:
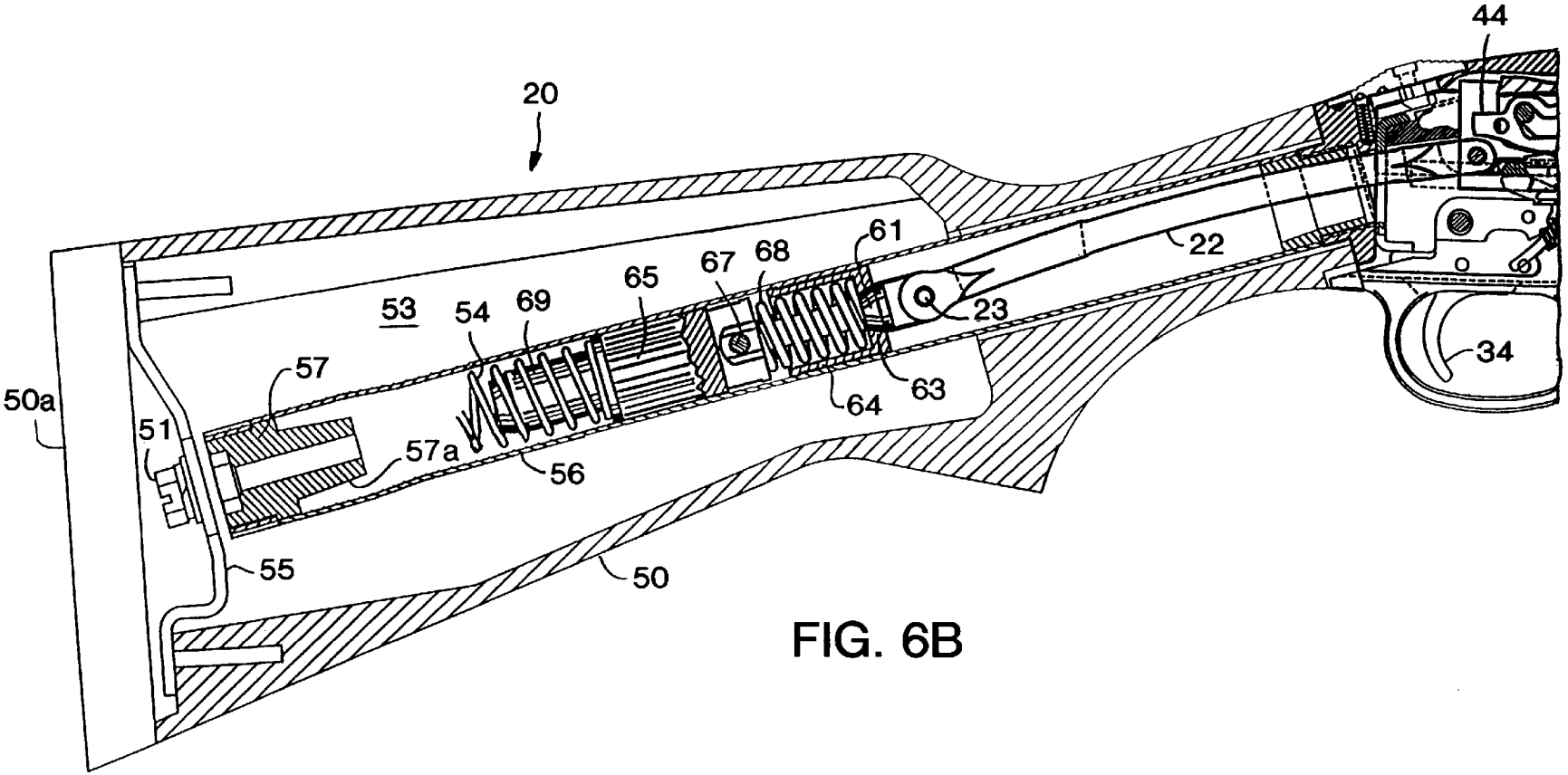
FIG. 6*b* is a side elevational view in cross-section of the stock portion of the embodiment of FIG. 1*b* at the time that the bolt and slide are in the full rearward position.

In the final position, depicted in FIGS. 6*a* and 6*b*, the slide and bolt are in the full rearward, reset delay position such that the rear end of slide 36 is in contact with buffer 90. Buffer 90 is preferably made from a resilient polymeric material such as nylon which may compress to observe the remaining energy of the slide, its final decelerator. In the rear stock inertial system, return spring 54 is now fully compressed. Accumulator spring 68 remains in its initial position. If the magazine 40 is empty, elevator 94 remains in a full unlocked position and the gun remains locked in the position depicted in FIG. 6*a*. However, if magazine tube 25 still contains a shell, the shell trips an elevator latch. This enables the elevator 94 to lift and the bolt/slide assembly to push the waiting round into the breech and stage the bolt into lock, positioning the weapon in the ready-to-fire battery position and completing the feeding cycle. The weapon will complete this cycle until the magazine is empty upon the act of pulling the trigger. This is referred to as the semi-automatic firearm mode.

If the feeding or cut-off system does not see any more shells in the magazine tube, the cut-off will lock the action open, rendering the weapon unloaded and visibly empty.

From the bolt open position, FIGS. 6*a* and 6*b*, a shell is loaded into the barrel 24 breech. (FIG. 1*a*.) A release button is depressed causing the elevator pawl 31 to move.

This allows the return spring 54 to move the bolt/slide assembly 42 into battery position locking the bolt lock 48 into the barrel extension lock window 84. Thus, the weapon is again ready for ignition.

The expansion force of return spring 54 provides the force to move the link and slide forward from the reset delay position and guide the shell back into the battery position as depicted in FIG. 1*a*, where the slide and bolt are in their lock-up position and the gun is ready to be fired again.

A second preferred embodiment of the preferred shotgun of the present invention is depicted in FIGS. 11–21. While the bolt/slide mechanism is essentially the same as in the previous embodiment, FIGS. 1–6, the inertial recoil assembly is different in that it adds a nitrogen gas cylinder 102 as an additional spring means in series with the relatively high spring rate accumulator compression spring 68, and connected to lower spring rate return spring 54. The gas cylinder spring also preferably has a significantly higher spring rate than the return spring. As shown therein, the nitrogen gas spring assembly replaces the inertial mass between the accumulator spring 68 and return spring 54 to provide both inertial mass and additional spring deformation in the inertial recoil and accumulation of the system. The combination is useful because the accumulator spring, as a mechanical spring, typically has a parabolic force/deformation curve, while the gas spring force/deformation curve is typically more linear. This enables the accumulator spring means to be tuned more efficiently to the desired construction of the firearm.

Figure 16A:
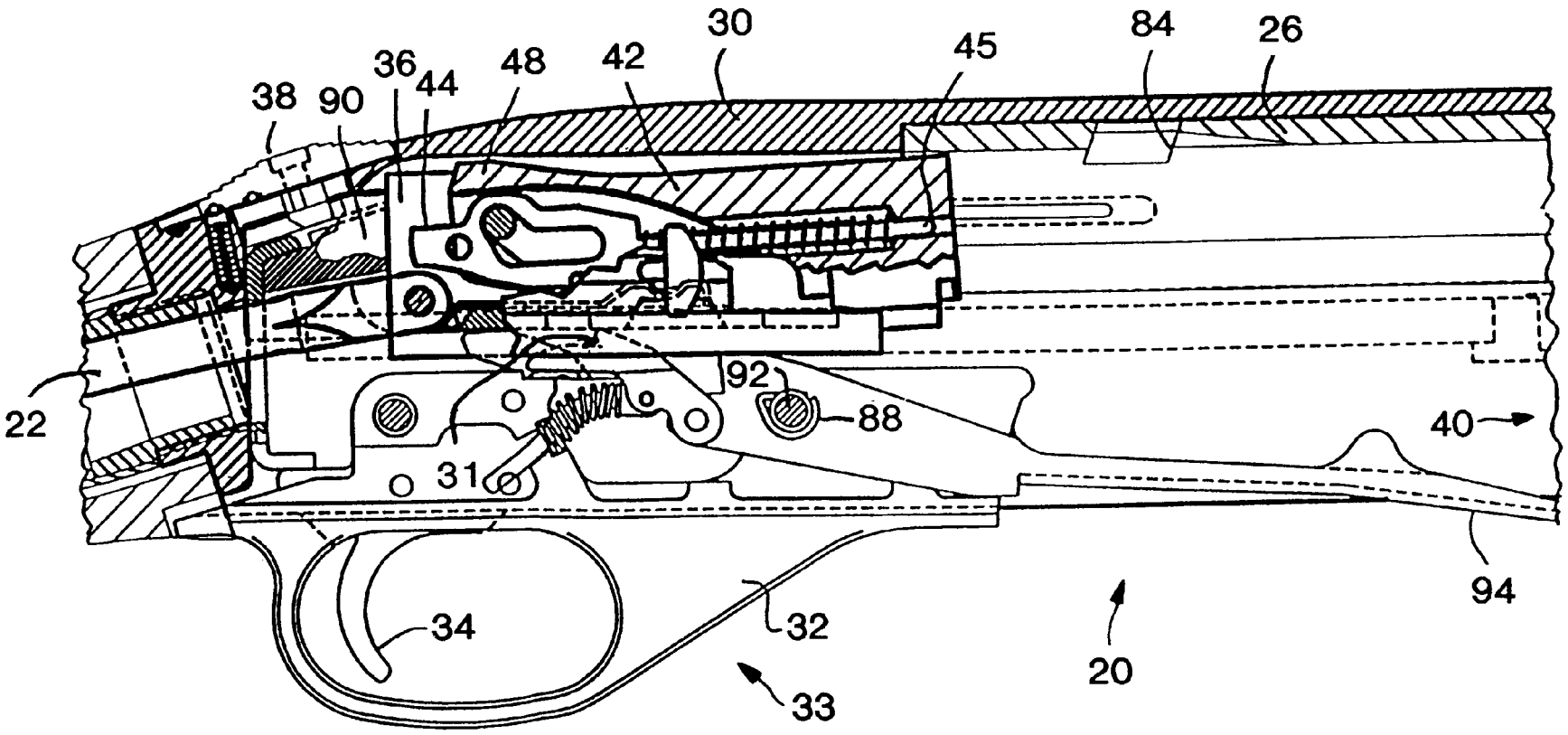
FIG. 16*a* is a side elevational view in cross-section of the embodiment of FIG. 11*a*, corresponding to the bolt open position shown in FIG. 6*a*.
Figure 16B:
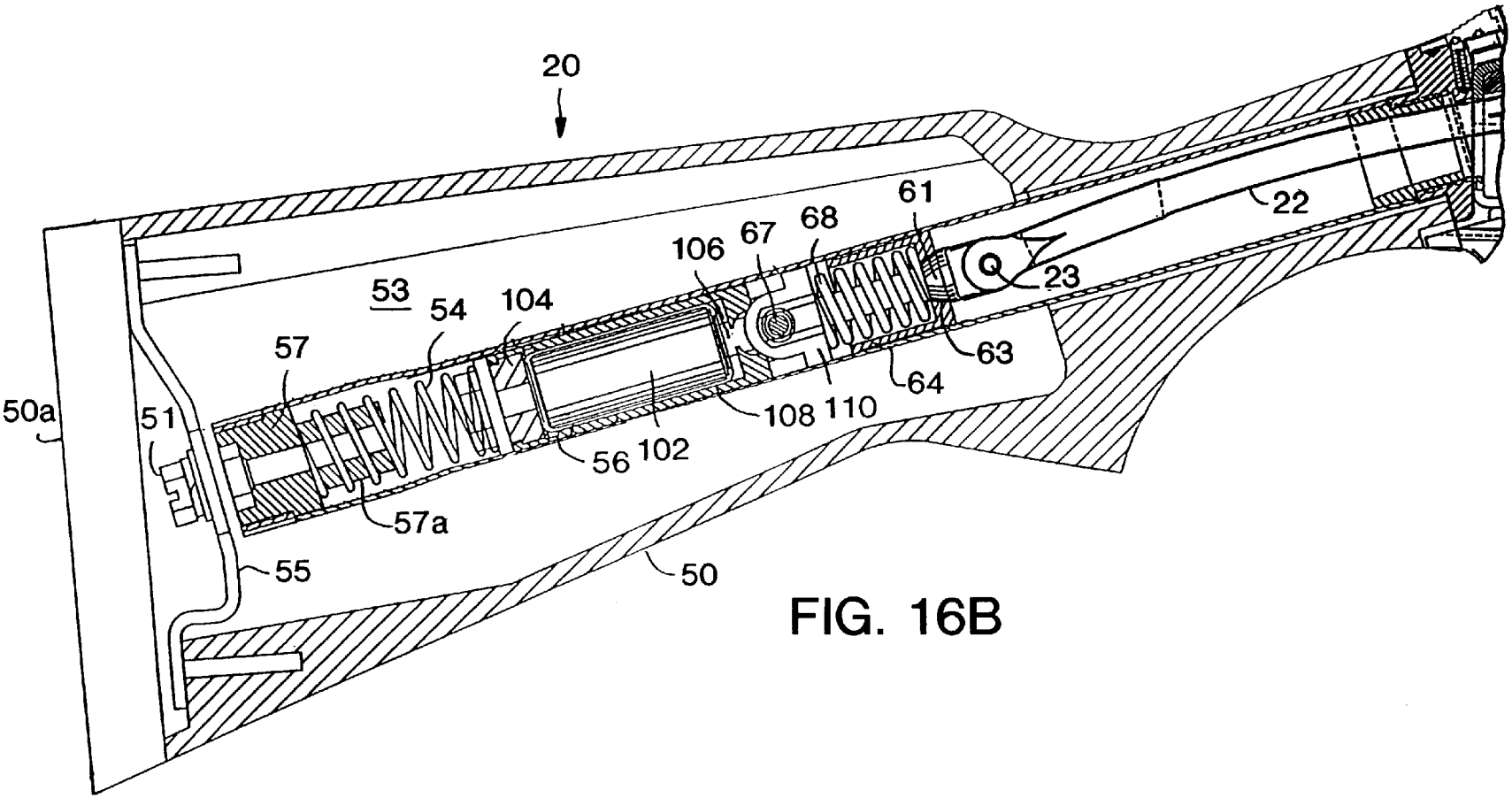
FIG. 16*b* is a side elevational view in cross-section of the embodiment of FIG. 11*b*, corresponding to the bolt open position shown in FIG. 6*b*.
Figure 17:
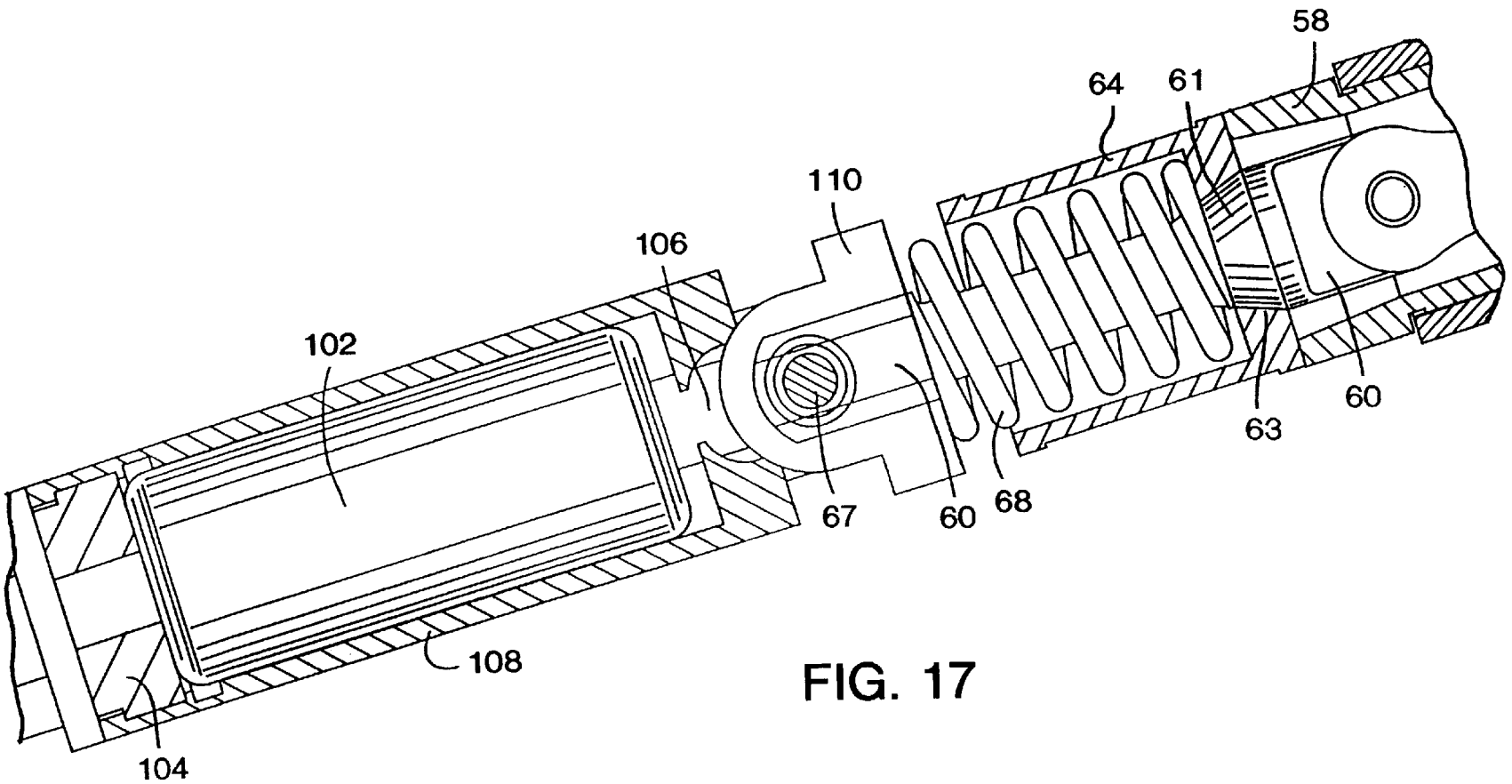
FIG. 17 is a side elevational view, partially in cross-section, of the combined accumulator spring means comprising a mechanical spring and a nitrogen gas cylinder spring.
Figure 18:
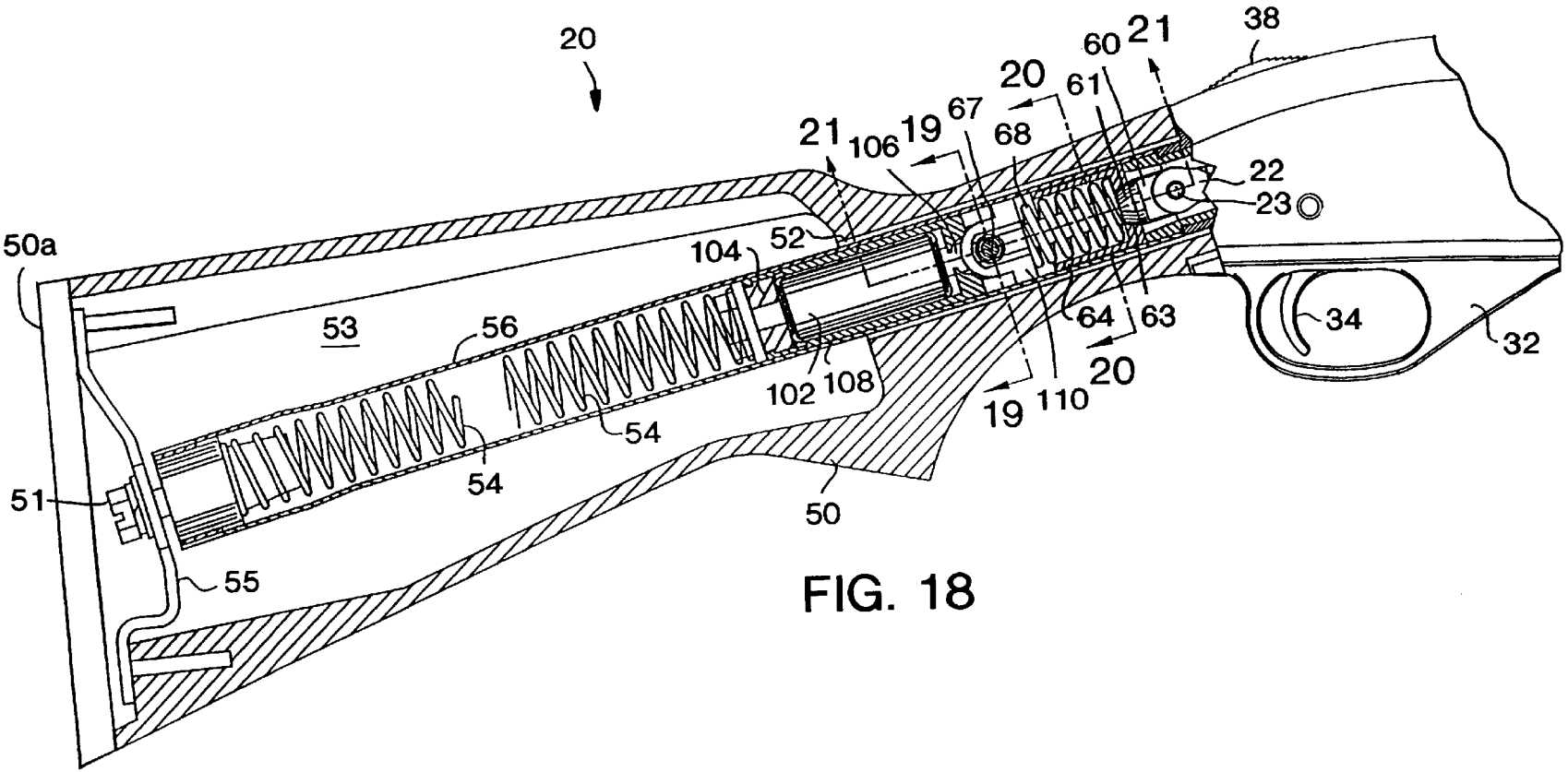
FIG. 18 is a side elevational view, partially in cross-section, of the stock and trigger portion of the preferred gun of the present invention incorporating the combination accumulator spring means of FIG. 17 in the battery position.
Figure 19:
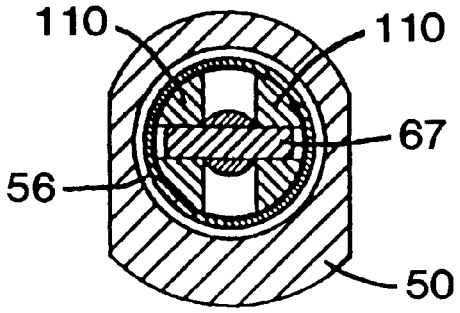
FIG. 19 is a cross-sectional view along lines 19—19 of FIG. 18.
Figure 20:
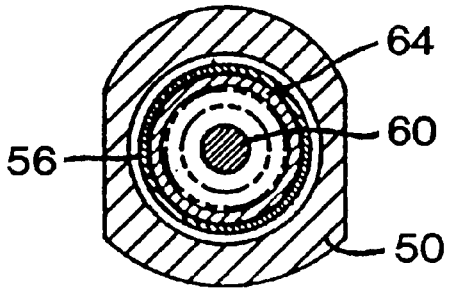
FIG. 20 is a cross-sectional view along lines 20—20 of FIG. 18.
Figure 21:
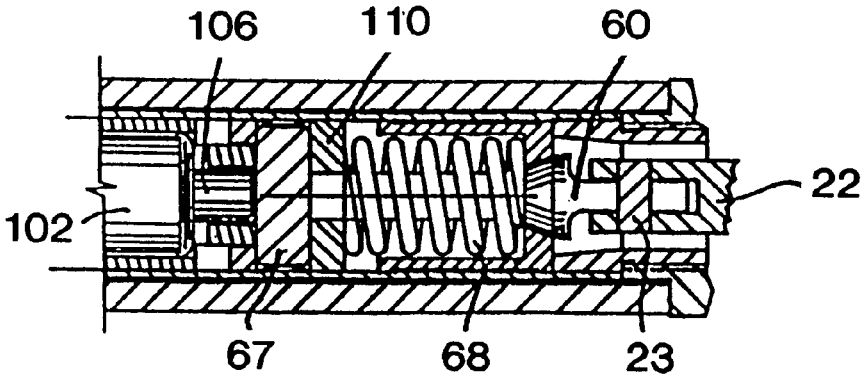
FIG. 21 is a cross-sectional view along lines 21—21 of FIG. 18.
Figure 22:
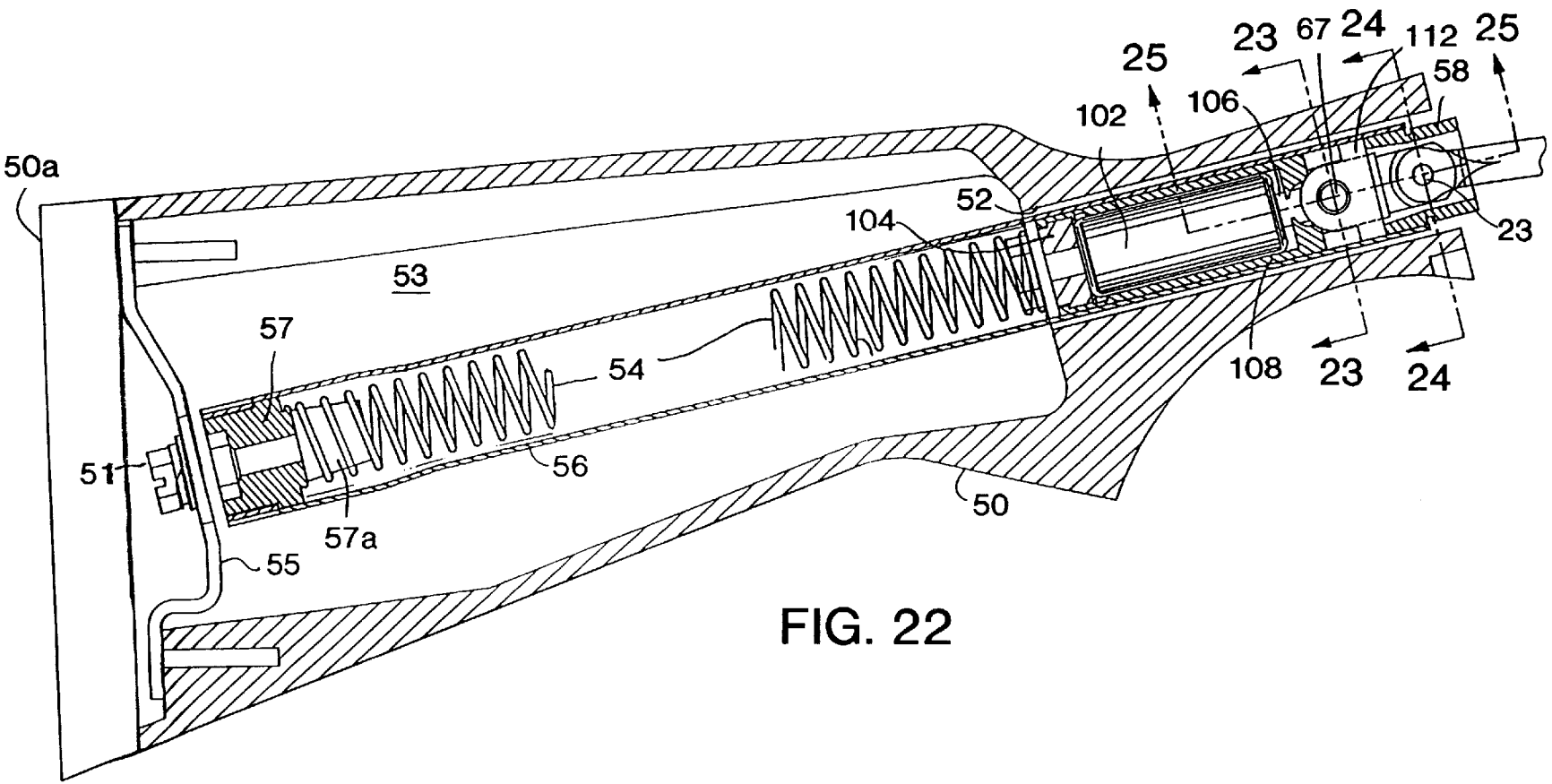
FIG. 22 is a side elevational view in cross-section of the stock portion of the gun of the present invention incorporating only a nitrogen gas cylinder spring as the accumulator spring.
Figure 23:
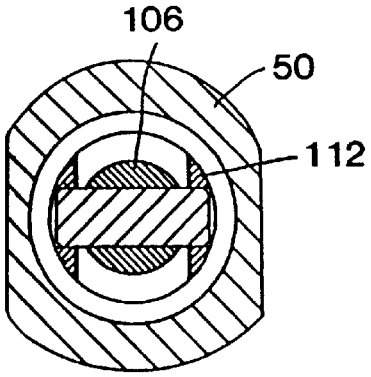
FIG. 23 is a cross-sectional view along lines 23—23 of FIG. 22.
Figure 24:
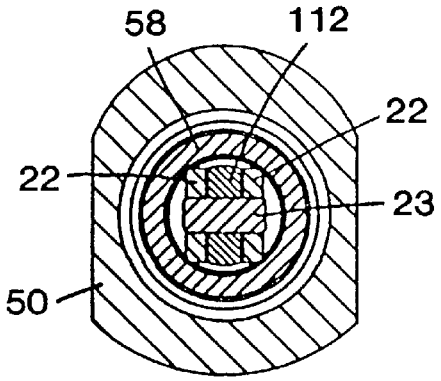
FIG. 24 is a cross-sectional view along lines 24—24 of FIG. 22.
Figure 25:
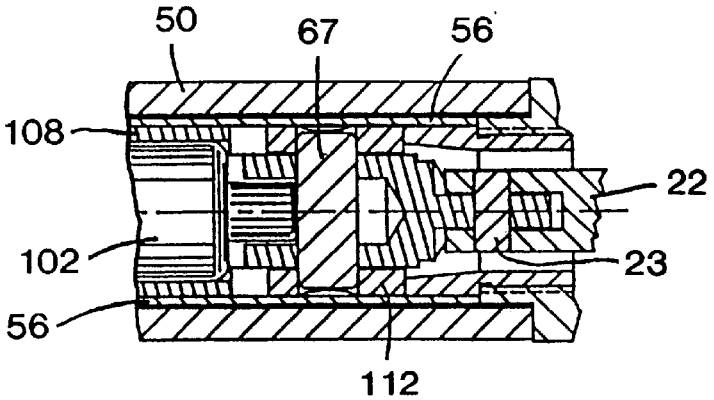
FIG. 25 is a cross-sectional view along lines 25—25 of FIG. 22.

As shown in FIGS. 11–21, and particularly in FIG. 17, nitrogen gas spring 102 has a slidable piston 106 extending at the forward end thereof. The forward end of piston 106 is connected by pin 67 to the rearward end of link 60. A bushing 110 slideable within tube 56 is also connected at pin 67, and contacts the rearward end of accumulator spring 68. Also in contact with bushing 110 is gas spring cup 108, into which is tightly fitted the body of gas spring 102. Gas spring cup 108 is itself slideable within guide tube 56. The rearward end of gas spring cup 108 is secured to spring guide 104, around which is secured the forward end of return spring 54. Gas spring 102 is in its initial position when piston is fully depressed into the cylinder body, and is deformed when the piston moves forwardly out of the cylinder body.

The differences in operation of the second preferred embodiment of the inertial recoil and accumulation system may be described below. The positions of the gun operating system of FIGS. 11–16 correspond to those shown in FIGS. 1–6, respectively, unless otherwise stated.

Figure 11A:
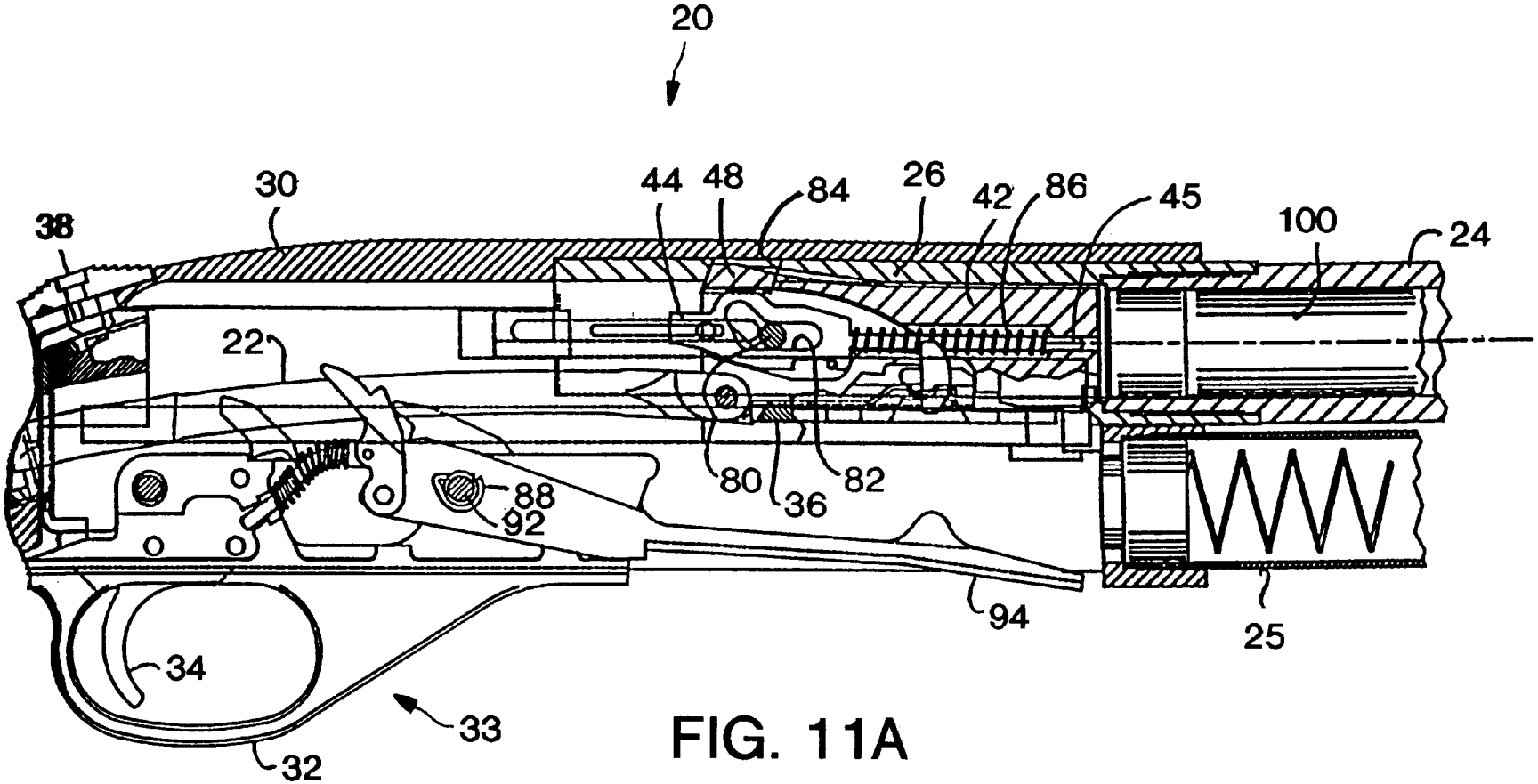
FIG. 11*a* is a side elevational view in cross-section of the barrel extension portion of a second preferred shotgun of the present invention at the time that the bolt and slide are in battery position before firing, corresponding to the position shown in FIG. 1*a*.
Figure 11B:
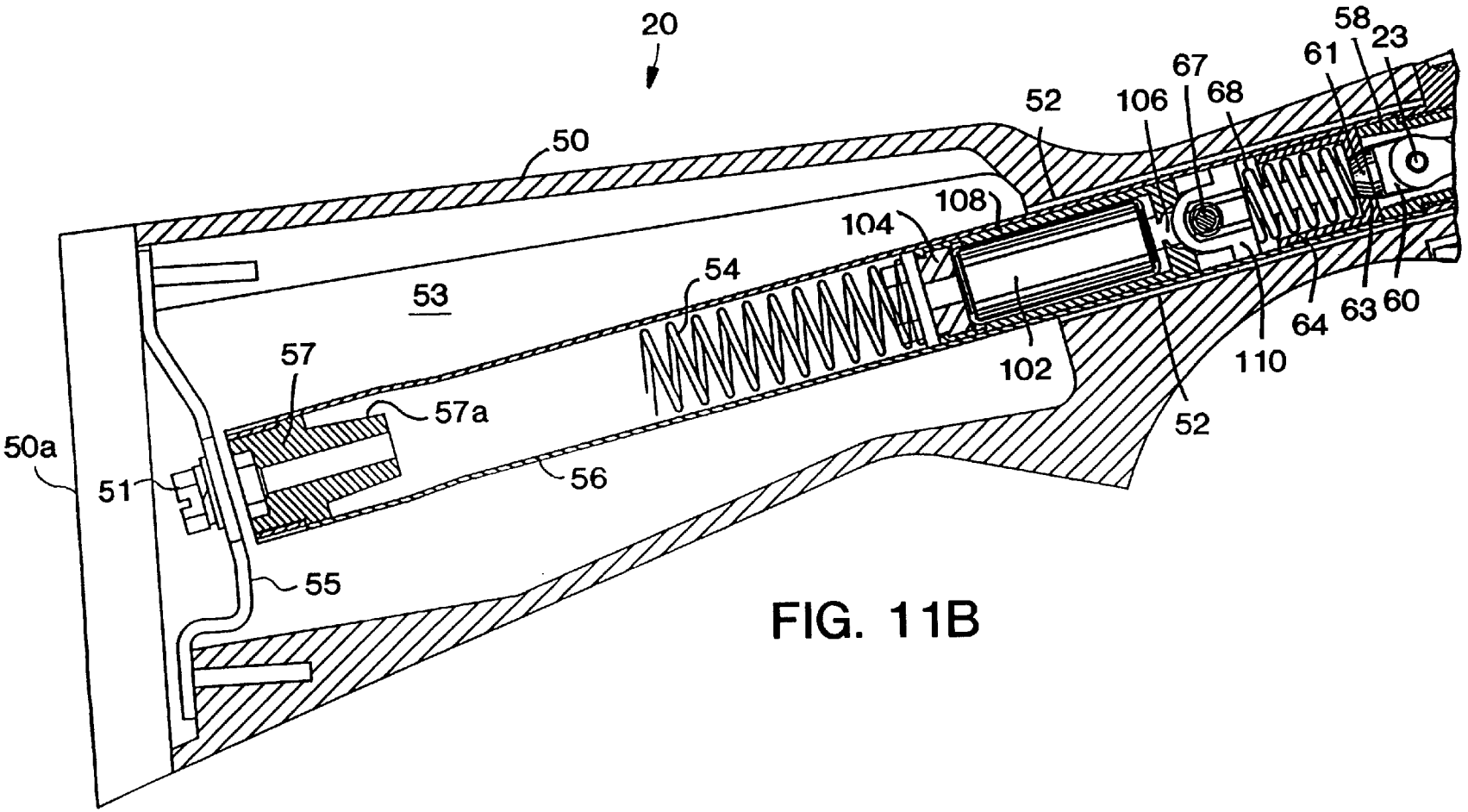
FIG. 11*b* is a side elevational view in cross-section of the stock portion of the second preferred shotgun of the present invention at the time that the bolt and slide are in battery position before firing, corresponding to the position shown in FIG. 1*b*.

Battery Position—FIGS. 11*a* and 11*b*.

In the battery position, gas cylinder 102 remains in its initial position, as does accumulator spring 68. (See also FIGS. 18–21.)

Figure 12A:
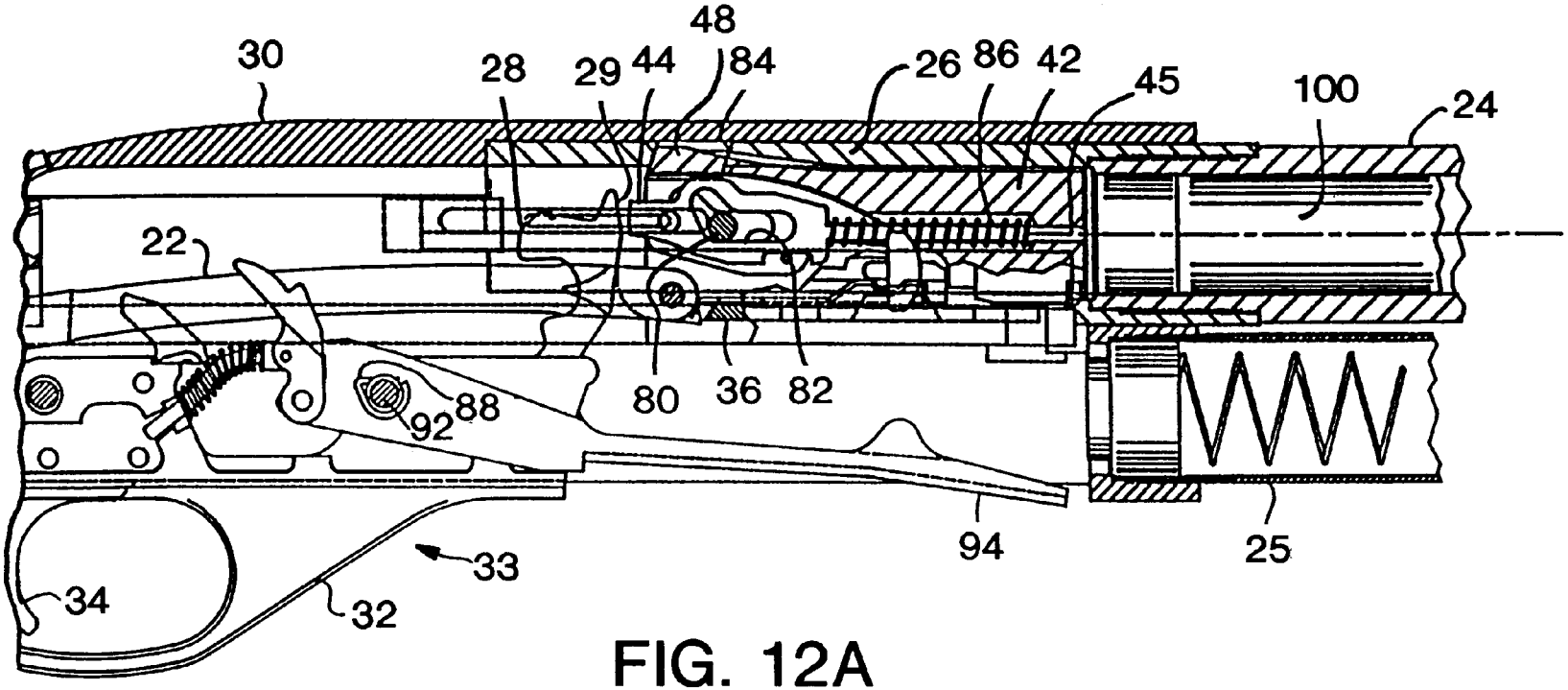
FIG. 12*a* is a side elevational view in cross-section of the embodiment of FIG. 11*a* corresponding to the fired position shown in FIG. 2*a*.
Figure 12B:
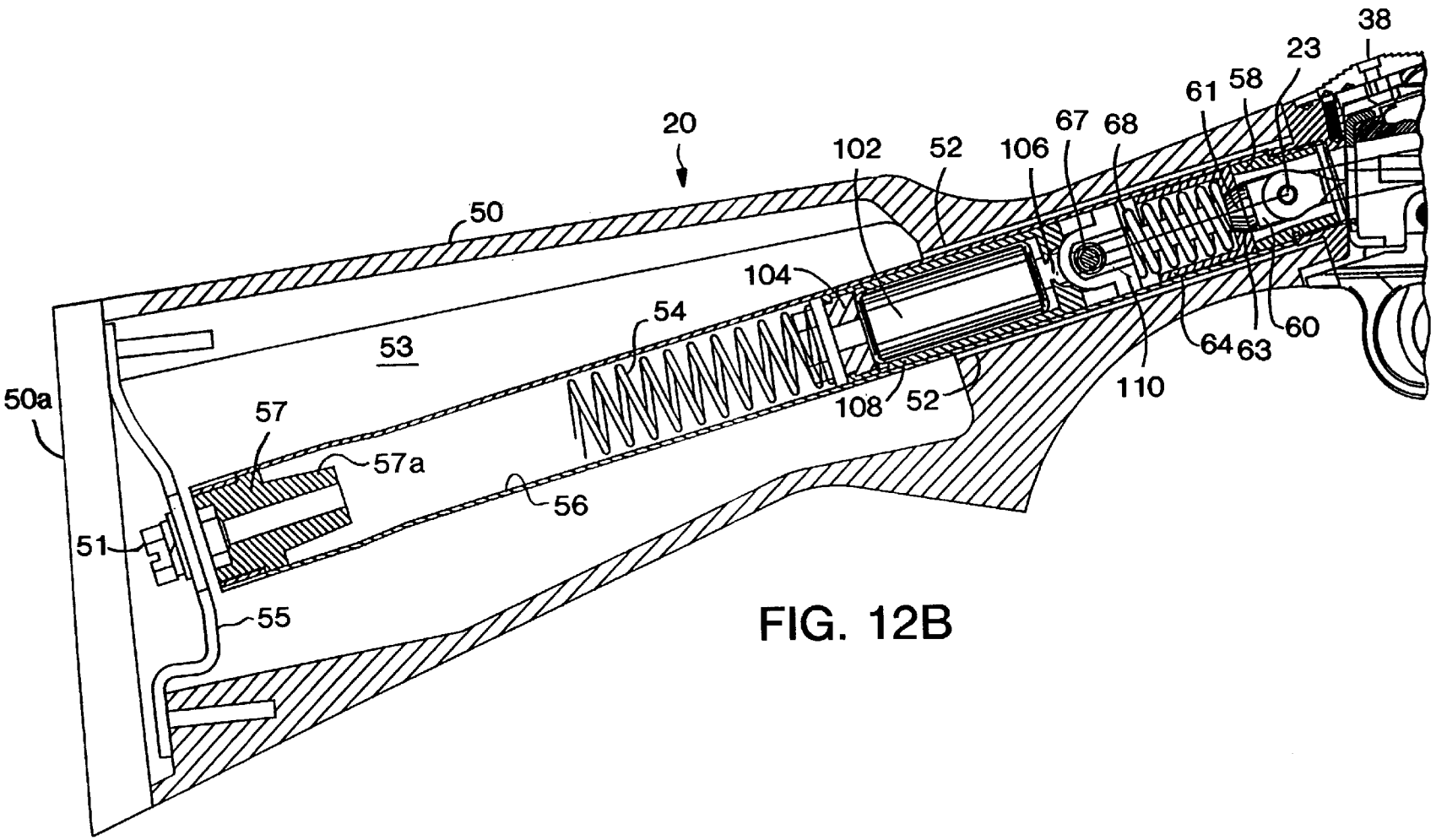
FIG. 12*b* is a side elevational view in cross-section of the embodiment of FIG. 11*b*, corresponding to the fired position shown in FIG. 2*b*.

Fired Position—FIGS. 12*a* and 12*b*.

Again, gas cylinder 102 remains in its initial position, as does accumulator spring 68, in the fired position.

Figure 13A:
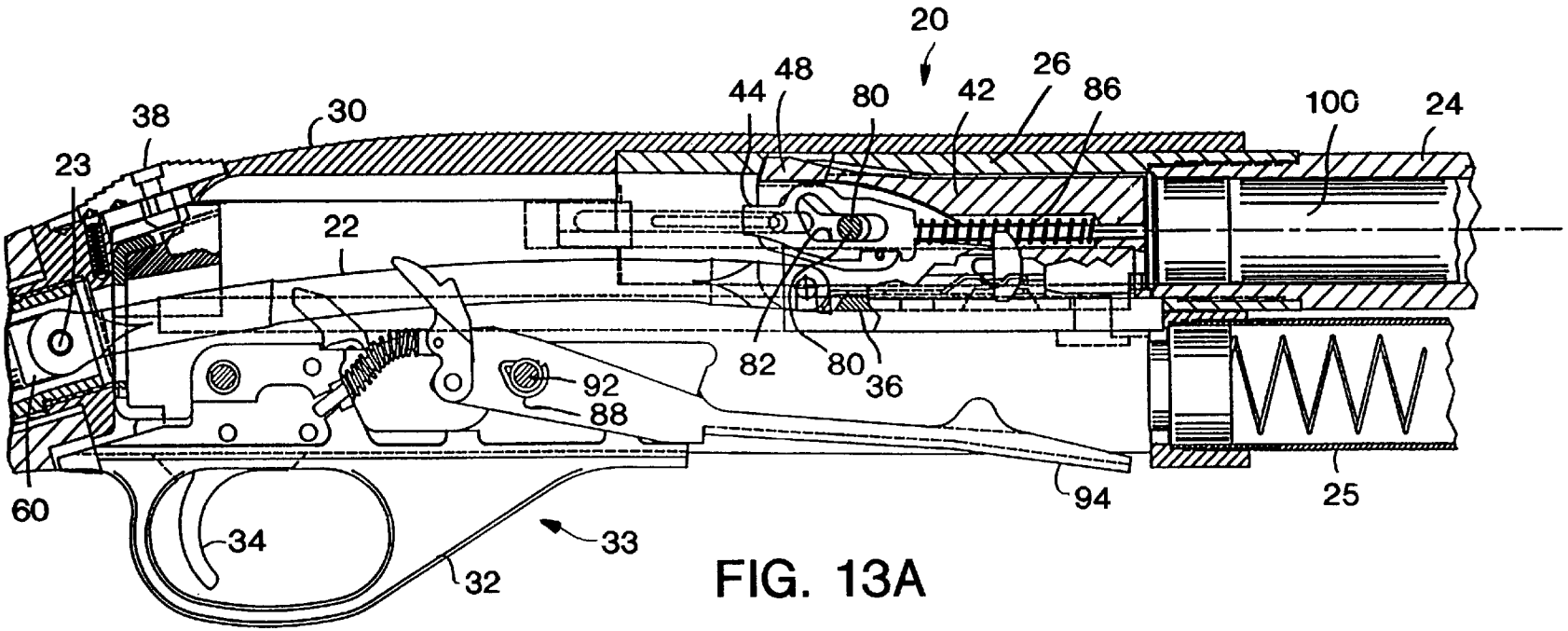
FIG. 13*a* is a side elevational view in cross-section of the embodiment of FIG. 11*a*, corresponding to the accumulation position shown in FIG. 3*a*.
Figure 13B:
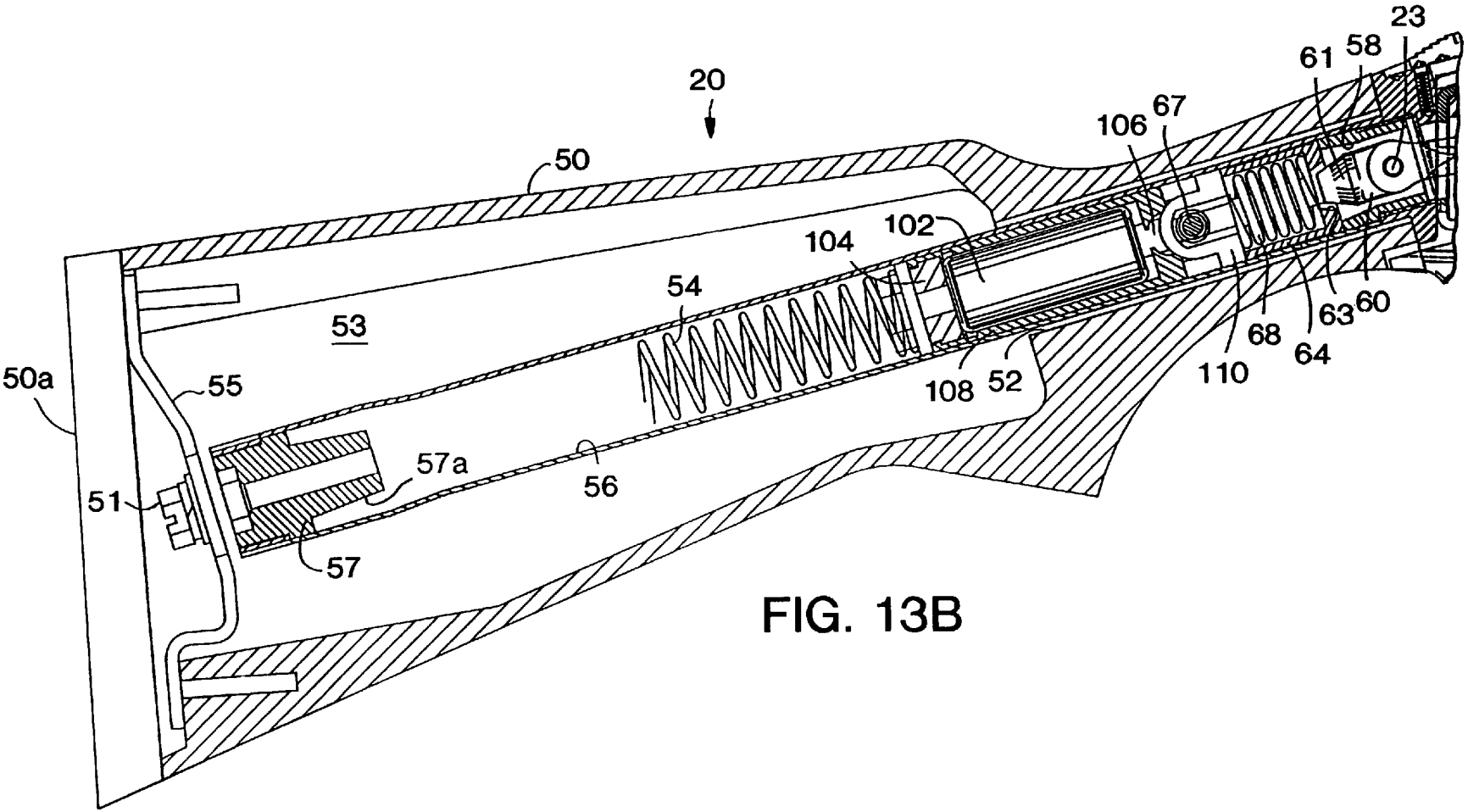
FIG. 13*b* is a side elevational view in cross-section of the embodiment of FIG. 11*b*, corresponding to the accumulation position shown in FIG. 3*b*.

Accumulation Position—FIGS. 13*a* and 13*b*

After the gun is fired and the gun begins to move backward in recoil, both gas cylinder 102 and accumulator spring 68 are deformed from their initial positions. Accumulator spring 68 is compressed in the manner previously discussed in connection with FIG. 3*b*, and piston 106 is extended from gas cylinder 102, sufficient to accumulate the energy expended from the shell ejecta. The proportion of energy absorbed by each of the accumulator spring and gas cylinder may vary according to the desired design constraints, but a proportion of 60% of energy absorbed by the accumulator spring and 40% of energy absorbed by the gas cylinder may be employed.

Figure 14A:
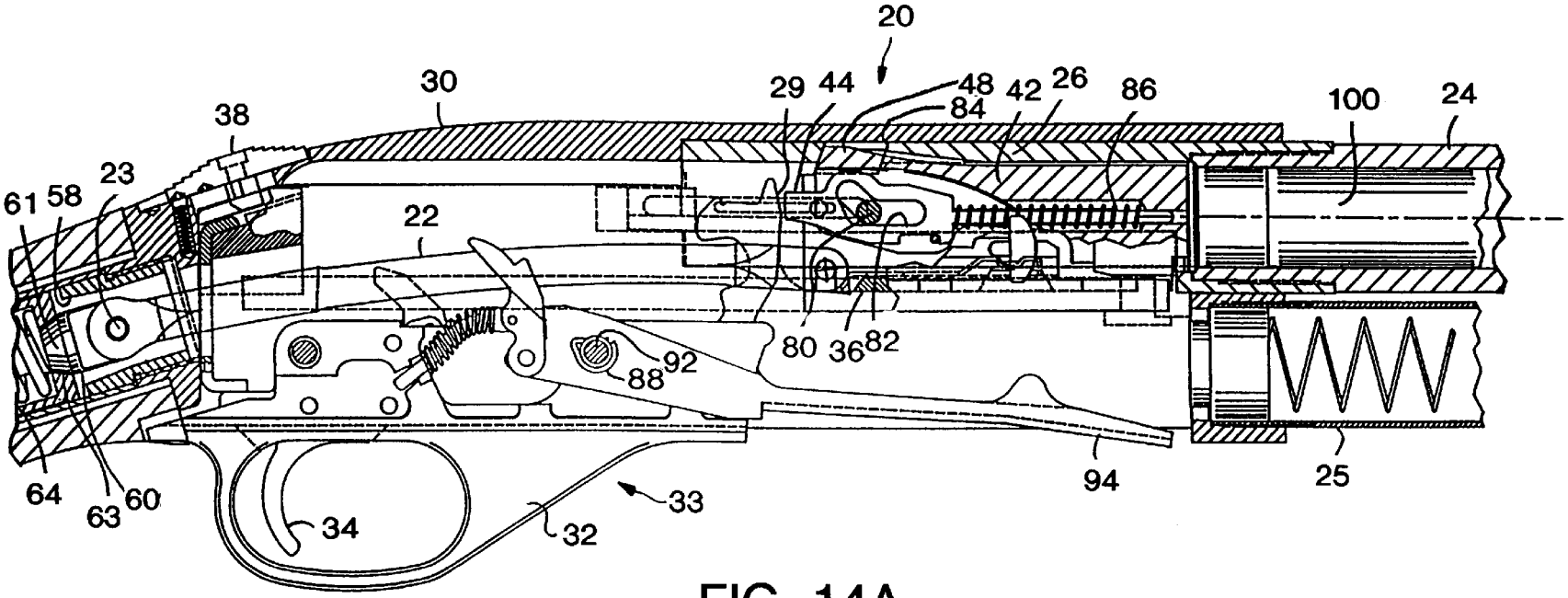
FIG. 14*a* is a side elevational view in cross-section of the embodiment of FIG. 11*a*, corresponding to the start-to-unlock position shown in FIG. 4*a*.
Figure 14B:
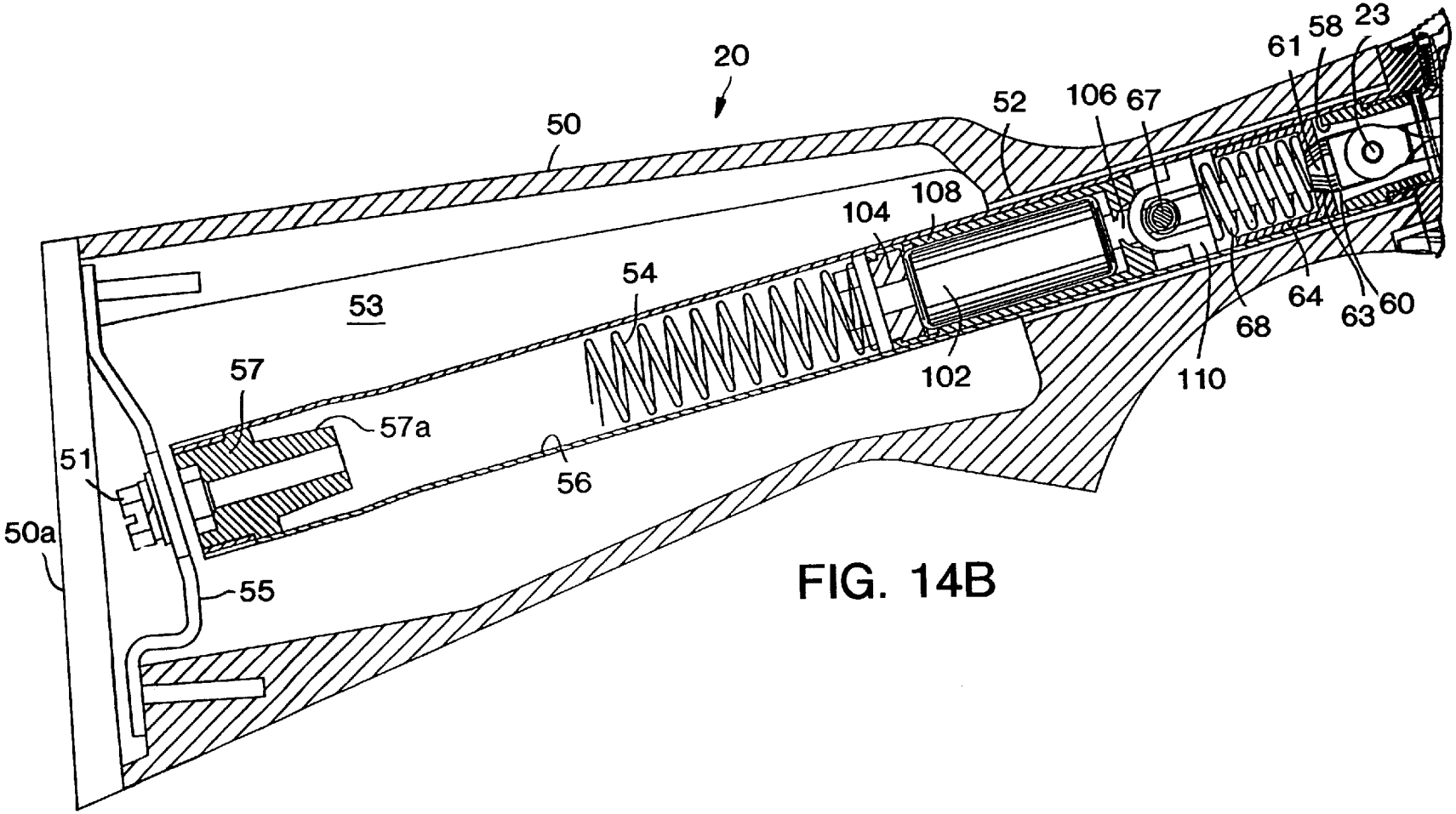
FIG. 14*b* is a side elevational view in cross-section of the embodiment of FIG. 11*b*, corresponding to the start-to-unlock position shown in FIG. 4*b*.

Start-To-Unlock Position—FIGS. 14*a* and 14*b*.

In the start-to-unlock position, gas cylinder 102 and accumulator spring 68 return to their initial positions.

Figure 15A:
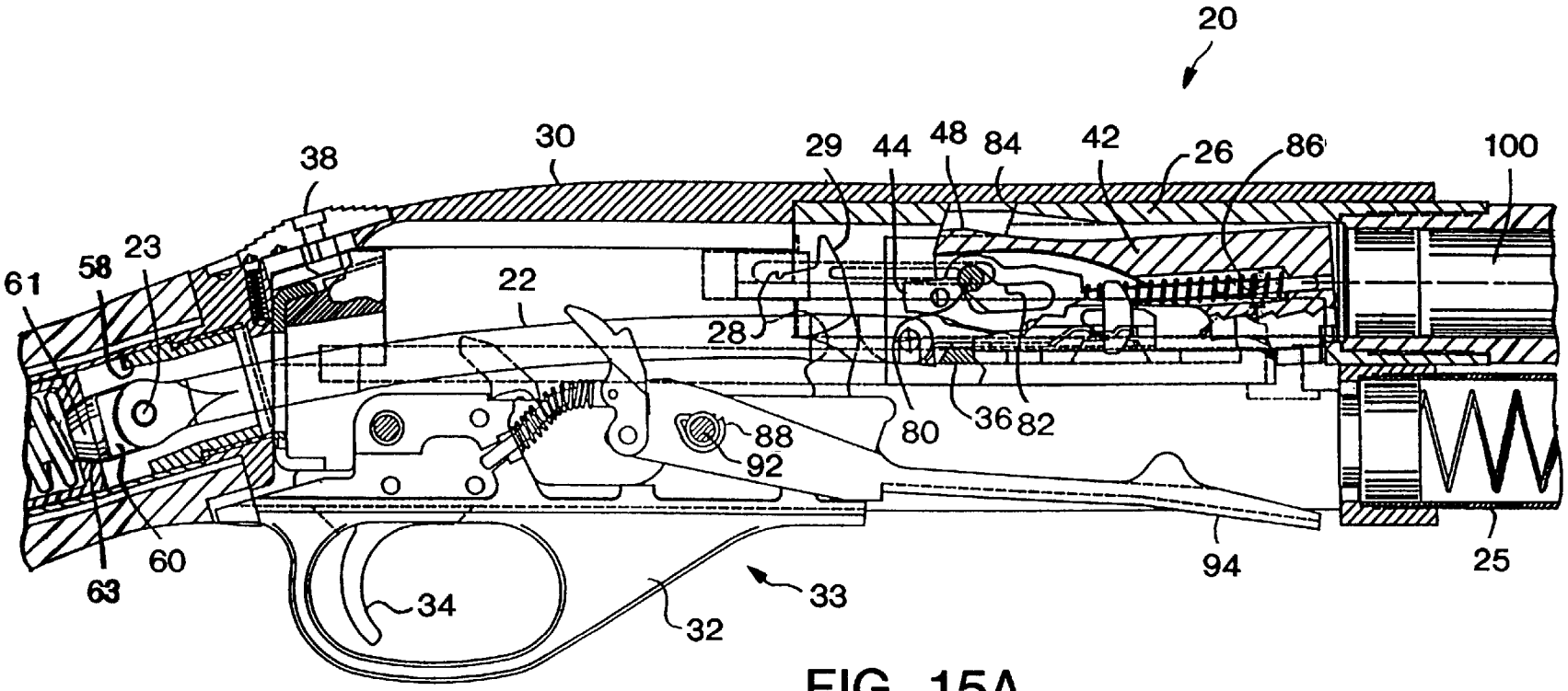
FIG. 15*a* is a side elevational view in cross-section of the embodiment of FIG. 11*a*, corresponding to the fully unlocked position shown in FIG. 5*a*.
Figure 15B:
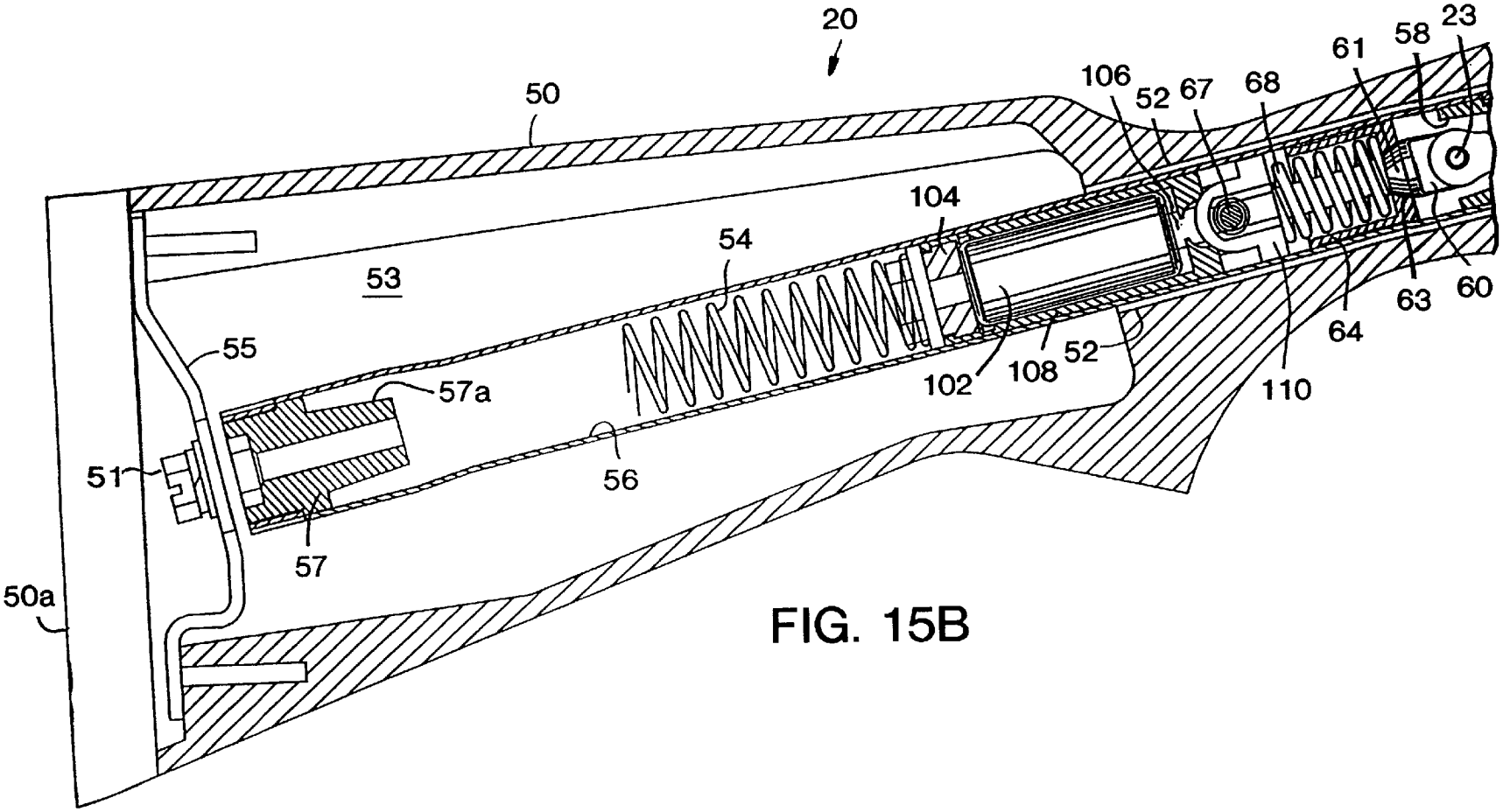
FIG. 15*b* is a side elevational view in cross-section of the embodiment of FIG. 11*b*, corresponding to the fully unlocked position shown in FIG. 5*b*.

Fully Unlocked Position—FIGS. 15*a* and 15*b*.

Again, gas cylinder 102 remains in its initial position, as does accumulator spring 68, in the fully unlocked position.

Bolt Open Position—FIGS. 16*a* and 16*b*.

Again, gas cylinder 102 remains in its initial position, as does accumulator spring 68, in the bolt open position.

Another embodiment of the present invention substitutes the gas cylinder 102 entirely for the accumulator spring. This is shown in FIGS. 22–25.

The nitrogen gas cylinder spring operates in the same manner as accumulator spring 68 as depicted in FIGS. 1–9. In the battery, fired, start-to-unlock, fully unlocked, and bolt opened positions, gas cylinder 102 remains in its initial position in which the piston 106 is fully pushed into the cylinder housing 102. When in the accumulation position, however, piston 106 is deformed and extended from gas cylinder 102 sufficient to accumulate the energy extended from the shell ejecta.

As shown in FIGS. 22–25, cylinder 102 is encased tightly within gas spring cup 108 which is moveably disposed within guide tube 56, ahead of the position of return spring 54. Spring guide 104 at the rear portion of gas spring cup 108 is adapted to contact the forward end of the returned spring. Gas cylinder piston 106 extends from the front of the cylinder 102 and cup 108 through an opening in the latter and is connected by pin 67 to bushing 112. Bushing 112 acts as the second link portion (comparable to link 60) in that it is pinned at its forward end by pin 23 to the rearward end of link 22. Bushing 112 differs in operation from link 60 in that it does not permit rotational movement around link 23 with respect to link 22 as did the embodiments in FIGS. 1–6 and 11–16. Bushing 112 fits snugly but in a sliding manner within guide tube 56. The operation of the nitrogen spring of FIGS. 20–25 also differs from the operation of the embodiment of FIGS. 1–9 in that the force/deflection curve is typically more linear than that for the mechanical accumulator spring 68, thereby changing the characteristics of deformation if so desired.

Unlike prior art recoil reduction devices, which revolve around the concept of a weight counteracting implied recoil forces through various dampening means (hence, they are reactive or secondary in nature), the present invention utilizes a recoil inertial system which is associated with the primary system of cycling the action and functioning of the weapon. This enables the gun operating system to operate more quickly (by a matter of milliseconds) through the disclosed and claimed embodiments to accumulate recoil faster than devices shown in prior art. Also, the placement of the inertial recoil mechanism in the butt stock of the weapon is superior to other inertial weapons. Additionally, the inertial recoil mechanism of the present invention is behind the center of gravity of the weapon and low to its anchor point (the user's shoulder), thereby creating a more solid foundation. Housing the inertial recoil assembly in the butt stock also enables a larger inertial mass and accumulator spring diameter to be utilized, since it presents the largest available cavity or envelope of free space in the weapon. Housing the inertial recoil mechanism in the butt stock also enhances the weapon's weight distribution as a percentage to its balance point.

In addition to the advantages of the operating system, the present invention employs an improved safety system and permits rapid and facile disassembly of the bolt/slide without removing the operating system from the gun The preferred embodiment depicted is useful in fast-repeating firearms and is able to accept 12 gauge shells of a variety of lengths, although, the present invention is adaptable to firing other size shells (e.g., rim fire or centerfire) as well, whether rifled or smooth bore, up to 40 mm or more in diameter. The present invention is applicable to all repeating rifle applications as well and is not limited to specific bores or calibers.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A gun operating system comprising:

a bolt/slide movable between a closed position prior to firing of said gun and an open position after firing of said gun;

a link operatively connected to said bolt/slide and movable therewith; and an inertial recoil assembly operatively connected to said link, said recoil assembly comprising a housing, a first spring having a first and a second end, and a second spring having a first and a second end, said first spring being movable within said housing between initial and deformed positions in a first direction, said second spring being movable within said housing between initial and deformed positions in a second direction, said first spring having a spring deformation rate higher than a spring deformation rate of said second spring, said first and second springs being operatively located in series within said recoil assembly housing;

whereby upon firing of said gun, said bolt/slide is adapted to move to said open position and said link is adapted to initially deform said first spring in said first direction and, subsequently, said first spring is adapted to return to an initial position and move said link and deform said second spring in said second direction.

2. The system of claim 1 wherein said second end of said first spring is operatively connected to said link and to said first end of said second spring.

3. The system of claim 1 wherein said housing of said recoil assembly is located in a gun stock.

4. The system of claim 1 wherein said first and second springs are operatively connected in series within said recoil assembly housing.

5. The system of claim 1 wherein said first spring comprises a mechanical spring having a deformation rate significantly higher than the deformation rate of said second spring.

6. The system of claim 1 wherein said first spring comprises a gas spring having a deformation rate significantly higher than the deformation rate of said second spring.

7. The system of claim 1 wherein said first spring comprises a mechanical spring, and further including a gas spring operatively connected in series to said mechanical spring.

8. The system of claim 1 wherein said second spring is adapted to deform a greater distance than said first spring upon firing of said gun.

9. The system of claim 1 wherein said link comprises first and second members connected by a pin and rotatable with respect to each other.

10. The system of claim 1 wherein said link comprises first and second link members, said first link member being operatively connected to said bolt/slide and said second link member being operatively connected to said first spring, and further including means for rigidly connecting said second link member to said first spring when said first spring is in said initial position.

11. The system of claim 1 wherein said link comprises first and second link members connected by a pin, said first link member being operatively connected to said bolt/slide and said second link member operatively connected to said first spring, said second link member being rigidly connected to said first spring when said first spring is in said initial position.

12. The system of claim 1 wherein said link comprises first and second link members connected by a pin, said first link member being operatively connected to said bolt/slide and said second link member operatively connected to said first spring, and further including a guide member having an opening therein in operative contact with the first end of said first spring, a portion of said second link member being rigidly secured within said opening of said guide member when said first spring is in said initial position.

13. The system of claim 1 further including an inertial mass movable in said housing between said first and second springs.

14. A gun operating system comprising:

a bolt/slide movable between a closed position prior to firing of said gun and an open position after firing of said gun;

a link operatively connected to said bolt/slide and movable therewith; and an inertial recoil assembly operatively connected to said link, said recoil assembly comprising a housing located within a gun stock, a first spring having a first and a second end, and a second spring having a first and a second end, said first spring being movable within said housing between initial and deformed positions in a first direction, said second spring being movable within said housing between initial and deformed positions in a second direction, said first spring having a spring deformation rate significantly higher than a spring deformation rate of said second spring, said first and second springs being operatively located in series within said recoil assembly housing, said second end of said first spring being operatively connected to said link and to said first end of said second spring, and an inertial mass movable in said housing between said first and second springs;

whereby upon firing of said gun, said bolt/slide is adapted to move to said open position and said link is adapted to initially deform said first spring in said first direction and, subsequently, said first spring is adapted to return to an initial position and move said link and deform said second spring in said second direction.

15. A gun operating system comprising:

a bolt/slide movable between a closed, locked position prior to firing of said gun and an open, unlocked position after firing of said gun;

a movable recoil assembly for operating said bolt/slide upon recoil of said gun immediately after firing;

links means operatively connecting said bolt/slide and recoil assembly, said link means comprising first and second link members, said first link member being operatively connected to said bolt/slide and said second link member being operatively connected to said recoil assembly; and means for rigidly connecting said second link member to said recoil assembly, said link means being adapted to remain essentially rigid when said bolt/slide is in said closed, locked and open, unlocked positions, except immediately after firing when said link is adapted to permit flexibility in a direction normal to movement of said recoil assembly.

16. The system of claim 15 wherein said link means comprises first and second members connected by a pin and rotatable with respect to each other.

17. A gun having a barrel, a barrel extension and a stock for resting against a user's shoulder comprising:

a bolt/slide movable in said barrel extension between a closed position prior to firing of said gun and an open position after firing of said gun;

a link operatively connected to said bolt/slide and movable therewith; and an inertial recoil assembly operatively connected to said link, said recoil assembly comprising a housing located within said gun stock, a first spring having a first and a second end, and a second spring having a first and a second end, said first spring being movable within said housing between initial and deformed positions in a first direction, said second spring being movable within said housing between initial and deformed positions in a second direction, said first spring having a spring deformation rate significantly higher than a spring deformation rate of said second spring, said first and second springs being operatively located in series within said recoil assembly housing, said second end of said first spring being operatively connected to said link and to said first end of said second spring, and an inertial mass movable in said housing between said first and second springs;

whereby upon firing of said gun, said bolt/slide is adapted to move to said open position and said link is adapted to initially deform said first spring in said first direction and, subsequently, said first spring is adapted to return to an initial position and move said link and deform said second spring in said second direction.

18. The gun of claim 17 wherein said gun comprises a shotgun and wherein said inertial recoil assembly is adapted for semi-automatic operation to repeatedly open and close said bolt/slide upon firing.

19. A gun operating system comprising:

a bolt/slide movable between a closed, locked position prior to firing of said gun and an open, unlocked position after firing of said gun;

a movable recoil assembly for operating said bolt/slide upon recoil of said gun immediately after firing;

link means operatively connecting said bolt/slide and recoil assembly, said link means comprising first and second link members connected by a pin, said first link member being operatively connected to said bolt/slide and said second link member operatively connected to said recoil assembly, said link means being adapted to remain essentially rigid when said bolt/slide is in said closed, locked and open, unlocked positions, except immediately after firing when said link is adapted to permit flexibility in a direction normal to movement of said recoil assembly; and a guide member having an opening therein in operative contact with said recoil assembly, a portion of said second link member being rigidly secured within said opening of said guide member when said recoil assembly is in an initial position.

* * * * *